US007536817B2

(12) United States Patent
Storch

(10) Patent No.: US 7,536,817 B2
(45) Date of Patent: May 26, 2009

(54) NO-SKIP RECOCKING REVOLVER

(76) Inventor: Leonard Storch, 175 W. 72nd St., Apt. 11F, New York, NY (US) 10023-3207

( * ) Notice: Subject to any disclaimer, the term of this patent is extended or adjusted under 35 U.S.C. 154(b) by 0 days.

(21) Appl. No.: 12/217,724

(22) Filed: Jul. 7, 2008

(65) Prior Publication Data

US 2009/0077853 A1 Mar. 26, 2009

Related U.S. Application Data

(60) Provisional application No. 60/994,698, filed on Sep. 21, 2007.

(51) Int. Cl.
*F41C 3/14* (2006.01)
*F41A 17/00* (2006.01)

(52) U.S. Cl. ..... 42/65

(58) Field of Classification Search ..... 42/59, 42/65, 66, 67; 89/155
See application file for complete search history.

(56) References Cited

U.S. PATENT DOCUMENTS

| | | | | | |
|---|---|---|---|---|---|
| RE124 | E | | 10/1848 | Colt | |
| 7,613 | A | | 9/1850 | Johnson | |
| 339,301 | A | | 4/1886 | Johnson | |
| 362,631 | A | | 5/1887 | Johnson | |
| 362,632 | A | | 5/1887 | Johnson | |
| 933,797 | A | | 9/1909 | Stone | |
| 3,051,057 | A | * | 8/1962 | Ivy | 89/193 |
| 3,237,336 | A | * | 3/1966 | Lewis | 42/59 |
| 3,242,607 | A | * | 3/1966 | Tappehorn | 42/65 |
| 3,337,979 | A | * | 8/1967 | Freed | 42/65 |
| 3,633,302 | A | * | 1/1972 | Lewis | 42/62 |
| 3,733,730 | A | * | 5/1973 | Baker | 42/65 |
| 3,768,190 | A | | 10/1973 | Ruger | |
| 3,916,551 | A | * | 11/1975 | Domian et al. | 42/67 |
| 3,988,847 | A | | 11/1976 | Kennedy | |
| 4,067,131 | A | | 1/1978 | Ruger et al. | |
| 4,128,957 | A | | 12/1978 | Lee | |
| 4,285,152 | A | * | 8/1981 | Dean | 42/59 |
| 4,468,876 | A | | 9/1984 | Ghisoni | |
| 4,641,449 | A | * | 2/1987 | Kapland et al. | 42/65 |
| 4,680,884 | A | * | 7/1987 | Smith et al. | 42/66 |
| 4,712,466 | A | * | 12/1987 | Ghisoni | 89/157 |
| 5,560,132 | A | * | 10/1996 | Merlino | 42/66 |
| 5,815,972 | A | | 10/1998 | Anderson | |
| 6,385,888 | B1 | | 5/2002 | Power | |
| 6,397,506 | B1 | | 6/2002 | Oglesby, Jr. | |
| 6,442,880 | B1 | * | 9/2002 | Allan | 42/70.08 |
| 6,523,294 | B2 | | 2/2003 | Curry et al. | |
| 6,571,502 | B1 | * | 6/2003 | Mikuta | 42/84 |
| 2003/0046851 | A1 | | 3/2003 | Papadimas et al. | |
| 2003/0192221 | A1 | | 10/2003 | Merlino et al. | |
| 2005/0126062 | A1 | | 6/2005 | Ghisoni et al. | |
| 2006/0242878 | A1 | | 11/2006 | Dubois et al. | |

* cited by examiner

*Primary Examiner*—Bret Hayes

(57) ABSTRACT

In a single or double action revolver, an improvement that prevents the cylinder from advancing upon being recocked should the revolver be decocked (uncocked) without firing. During or after decocking, a pawl (hand) retainer may be automatically set or manually set by the shooter. When the retainer is set it prevents the pawl from engaging the cylinder ratchet and rotating the cylinder past a live round when recocked. The retainer may be automatically or manually reset so that the cylinder will advance when the revolver is subsequently recocked.

23 Claims, 5 Drawing Sheets

NO-SKIP RECOCKING REVOLVER

This application claims priority to U.S. Provisional Application Ser. No. 60/994,698 filed Sep. 21, 2007. The entire contents of U.S. Provisional Application Ser. No. 60/994,698 are herein incorporated by reference.

BACKGROUND

The historically infamous Colt single action machines that won the West, called revolvers, a handgun with a cylinder of several chambers brought, by cocking a hammer, successively into line with the weapon's barrel and discharged with the same hammer. Samuel Colt's invention of the revolver in 1835 marked a great moment in American history—his revolvers were referred to as "The Great Equalizer" because, with a loaded Colt in hand, a frail person could fend off a brute. A double action revolver, which evolved after the single action, is a handgun with a cylinder of several chambers brought, by cocking a hammer or pulling the trigger, successively into line with the weapon's barrel and discharged with the same hammer.

Typically, in a single action revolver, uncocking involves pulling the trigger to release the hammer, releasing the trigger to its forward position and slowly letting the hammer down, thus allowing the pawl (which is pivotally connected by a pin or stud to the hammer and is thus operated by the hammer) to lower so as to be in position to rise when recocked to engage a tooth in the cylinder indexing ratchet to advance the cylinder one chamber.

Typically, in a double action revolver, uncocking involves pulling the trigger to release the hammer and slowly letting the hammer down, and releasing the trigger to its forward position thus allowing the pawl (which is pivotally connected by a pin or stud to the trigger and is thus operated by the trigger) to lower so as to be in position to rise when recocked to engage a tooth in the cylinder indexing ratchet to advance the cylinder one chamber.

Typically, in a double action revolver, cocking the hammer with the thumb causes the trigger to be pulled back toward the handle to put the trigger into firing position (comparable to a single action trigger position) so that only a small trigger travel remains to be pulled by the shooter to fire the revolver. Comparatively speaking, the trigger travel in a single action is less, i.e., traversing less distance, than in a double action revolver.

Some revolvers have more or less functions and features than other revolvers. For example, some Colt single action revolvers can be "fanned," like in a cowboy movie, to increase the rate of fire, and they have multiple positions for the hammer and pawl which may be described as follows:

(i) down and dangerous (hitting the hammer, which is resting on the firing pin, with a round in the chamber under the hammer can discharge the gun), with the pawl in the low position, (ii) safety, the hammer is locked back a bit out of touch with the firing pin, with the pawl in the low position, (iii) load or unload, with the pawl having risen to mid position rotating the cylinder to align with the loading gate, and allowing the cylinder to rotate by hand in one direction to align each chamber successively with the loading gate, and (iv) fully cocked, with the pawl having risen to top position to align a chamber with the barrel, ready to fire.

The present invention may also be used with another valuable revolver feature called a "Trigger Cocking Double Action" revolver which is described below. The inventor of the present invention is neither a gunsmith nor a machinist by trade. However, the inventor is an avid shooter, passionate about Second Amendment Rights, and an experienced inventor by trade having patented several diverse inventions. The inventor has U.S. Army and civilian experience target shooting and hunting with various hand guns and rifles and, at least when younger, was a dead shot earning a marksman medal in the Army.

It is the ambition of this improved revolver inventor to have this present "Non-Skip Revolver" invention manufactured in superior quality "Non-Skip Trigger Cocking Double Action Revolvers" in 22 mag. and 44 mag. calibers for plinking and hunting, and in a small light weight five shot .38 Spl. for personal protection, and perhaps a licensed manufacturer(s) will offer a special edition set including all three caliber revolvers celebrating the Supreme Court's historic Jun. 26, 2008 Second Amendment Decision.

When you think about the improvement, it brings a modern revolver's functioning in line with a semi-automatic pistol's functioning; when you decock a pistol, it does not skip a round as do revolvers—the innovation brings a key safety and functional advantage of a pistol to a revolver.

In 1891, Andrew Fyrberg invented the "safety lifter" or transfer bar (mentioned below). The present improvement represents another revolver safety advance. Ill-advised as it may be, it is just too tempting to hunters in the blood rush of hot pursuit of game to holster a cocked revolver to avoid skipping a round, for example, if their targeted game wanders off and they don't take their shot. Many a leg has been shot this way. Revolver accidents account for numerous lawsuits against manufactures. With this new safety feature, a hunter can decock, avoid skipping a round and holster safely.

PRIOR ART PUBLICATIONS

Ruger Revolver Online Manuals

Ruger single action and double action revolver manuals, including instructions, exploded diagrams and parts lists, may be found on Ruger's website.

"GUNS MAGAZINE" article discussing gun part names:

"The name game part II: revolvers" (portions reprinted below)

"Guns Magazine," March 2005, by J. B. Wood

"For readers who may have missed the first segment of this series, on Auto Pistols, it may be a good idea to revisit one of the terms discussed: Double Action. As used by Daniel Baird Wesson in 1878, it described a revolver that could be operated in two ways—by thumb-cocking the hammer and pulling the trigger, or by pulling he trigger to cock and release the hammer. Thus, a "double" action.

As time passed, the original meaning underwent a change. Cocking with the thumb became single action and the other way came to be called "double action." In more recent times, double action is usually abbreviated "DA.". . .

Among revolver terms, there is less room for error or confusion. I mean, what else can you call a cylinder, frame and barrel? The old-style guns with the tip-over barrel/cylinder unit are sensibly referred to as top-breaks, and modern revolvers have a swing-out cylinder, a good descriptive term for their operation.

The only area that gets a little cloudy is the naming of individual parts. Part of this can be attributed to the in-shop language of various manufacturers. Here's an example: At Smith & Wesson, the little gadget that arrests the rotation of the cylinder and locks it in place has always been called the cylinder stop, and that's the term I have used when writing about revolvers. At Colt, however, this part is called the bolt. Ruger, by the way, calls that part the cylinder latch.

In the same area is the lever that engages the ratchet to rotate the cylinder. Both Colt and Smith & Wesson refer to it as the cylinder hand. Ruger calls it the pawl, a proper engineering term to go with ratchet.

Many modern revolvers use some form of a transfer bar system. The hammer never touches the firing pin. Contact is made only when the trigger has lifted the transfer bar to fill the recessed space at the front of the hammer. When Andrew Fyrberg designed the first one for Iver Johnson in 1891, he called it a safety lifter.

Ruger sensibly calls this part the transfer bar. which accurately describes its function, as it transfers the hammer force to the firing pin. At Colt, it's the safety connector, and Charter Arms refers to it as the hammer block. . . .

How about the little flipper in the front of the hammer that the trigger contacts to tip the hammer back in double action firing? Charter calls it the hammer pawl. At Colt it's the hammer strut, and the Ruger term is hammer dog. For some strange reason, Smith & Wesson refers to it as the sear. In most of its usage, that term denotes a part that holds the hammer at full cock until the trigger moves it to the release point. Its use here, in a DA function, is a little odd. While working on this series of articles, I was discussing "the names of things" with a visiting local gunsmith. At the time, he was holding a revolver with the cylinder swung out. Jokingly, he indicted the open area of he frame normally occupied by the cylinder, and said, "What would you call that?"

My wife was nearby, and she said "That's easy. The cylinder space." So, in the future. when anyone uses that term. be sure to credit Judith Wood."

COPYRIGHT 2005 Publishers' Development Corporation

COPYRIGHT 2005 Gale Group

PRIOR ART PATENTS & TRIBUTE

Curry et al's. U.S. Pat. No. 6,523,294, "Revolver-safety lock mechanism," the description and Figures of which are incorporated herein in their entirety for reference, provides the Background Information: "A revolver includes a frame, a cylinder, a firing mechanism, and a barrel. The cylinder includes an ejector, a ratchet, a plurality of chambers, and a cylinder retaining mechanism. The cylinder is mounted on the frame by a yoke pivotally attached to the frame. In the cylinder-closed position, the cylinder retaining mechanism retains the cylinder within the frame. A cylinder release bar that can be moved via a thumb piece is provided to actuate the retaining mechanism and thereby allow the cylinder and yoke to be rotated away from the frame into the cylinder-open position. The firing mechanism includes a trigger, a sear, a hammer, a main spring, and a pawl that is sometimes referred to as a 'hand'. When the revolver is in an operable mode, pulling the trigger causes the pawl to engage the ratchet and thereby rotate the ratchet and attached cylinder. Pulling the trigger also causes the sear and the hammer to rotate away from the cylinder. The rotation away from the cylinder is resisted by the main spring. After a predetermined amount of travel, the sear and hammer disengage from the trigger and allow the spring to force the hammer toward the cylinder. The hammer is aligned with one of the cylinder chambers and the cylinder chamber, in turn, is aligned with the barrel. A hammer nose attached to the hammer is positioned to strike the cartridge disposed in the chamber."

Power's U.S. Pat. No. 6,385,888 ('888), "Revolver firing mechanism with disengaging cylinder pawl" describes the operation of a revolver. Power's description and Figures are incorporated herein in their entirety for reference. Power's invention allows the cylinder to be rotated in either direction; from Power's ABSTRACT:

". . . . The resulting disengagement of the engagement end and the cylinder indexing ratchet provides for a free spin of the cylinder of the revolver in either direction during loading and unloading of the revolver."

A conventional revolver's pawl is biased or urged toward the indexing ratchet on the end of the cylinder by some type of spring or other urging means. For example, as shown in FIG. 1 of Power's '888 patent, pawl 10 is biased toward the cylinder's indexing ratchet as described in this excerpt from column 6, line 60 to column 7, line 7:

"In this embodiment of the pawl 10, when the hammer 18 rotates on its mounting pin 39 to the at rest position 29, the cam end 30 contacts the wall surface 34 of the conventional interior shaft 14 formed in the revolver frame 36 of the revolver. Contact of the cam end 30 with the wall surface 34 of the interior shaft 14 in the revolver frame 36 during travel upward and downward in the interior shaft 14, is maintained by a biased plunger 38 in contact on the first side 21 of the first section 19 opposite the second side 23 adjacent to the cylinder indexing ratchet 22. The biased plunger 38 is normally biased toward the indexing ratchet 22 by a biasing means such as a spring 40. Such biased plunger 38 arrangements are common on conventionally manufactured revolvers using the conventional permanently engaged conventional pawl 11."

Power's '888 patent comprises modified pawl and pawl arrangements, including, for example, specially configured cylinder pawl 10, their modified paths of travel, and parts and modified parts associated therewith in order to free the cylinder to allow for two-way rotation during loading and unloading. In prior art revolvers to Power's '888 invention, the pawl prevents two-way rotation. Parts and modified parts may include, for example, an adjustable raised portion 54, fixed raised portion 52 or 56 and/or lower edge 62 of window 60. As mentioned below, Power's various parts and/or modified parts may be used in association with one or more embodiments of the present invention as will be evident to those skilled in gun smithing and related machinist arts.

Ruger et al's. U.S. Pat. No. 3,768,190 ('190) describes the operation of a single action revolver. Ruger et al's. description and Figures are incorporated herein in their entirety for reference. Ruger et al's. invention comprises a spring loaded gate retainer; from Ruger et al's. ABSTRACT:

". . . to retain the loading gate in position on the frame and to releasably detain the loading gate in its closed position when closed and in its open position when open."

This is from Ruger et al's. '190 patent column 4, line 48 to column 5, line 14:

"The cylinder 3 is formed with a plurality of cartridge receiving chambers 20 and with a like number of cylinder notches 21 on the outer surface thereof, and it is provided with a cylinder ratchet 22 at the rearward end thereof. A cylinder latch 23 is pivotally mounted on the frame underneath the cylinder 3, the cylinder latch having a nose 24 that is adapted to engage the cylinder notches 21 formed in the cylinder 3. A spring loaded cylinder latch plunger 25 urges the nose 24 of the cylinder latch into engagement with the lowermost notch 21 of the cylinder 3 so that each chamber 20 of the cylinder is successively held in alignment with the bore of the barrel 2 when the nose 24 of the cylinder latch successively engages the cylinder notches 21 formed in the cylinder 3.

"As shown best in FIG. 3, the hammer 5 is formed with a cam surface 27 that is adapted to contact the rearward surface 28 of the upwardly extending arm 29 of the trigger 7 when the hammer is being cocked and with a sear notch 30 that is adapted to engage the sear 31 of the trigger 7 when the hammer is cocked. A spring loaded hammer latch plunger 33 is mounted on the hammer 5 in position to momentarily contact the rearward arm portion 34 of the cylinder latch 23 when the hammer is being cocked. As best shown in FIGS. 2 and 3, a cylinder pawl 36 is pivotally mounted on the hammer 5 by means of the pin or stud 37. The upper end of the cylinder pawl 36 is formed with two vertically spaced ratchet engaging lugs 38 and 39. The lowermost lug 38 is adapted to engage the teeth of the cylinder ratchet 22 when the hammer is being cocked, and the uppermost lug 39 is adapted to engage the teeth of the ratchet 22 when the cylinder is being loaded in the manner hereinafter described."

This is from Ruger et al's. '190, patent column 10, lines 6 to 28:

"As previously noted, the cylinder pawl 36 is provided with two vertically spaced ratchet engaging lugs—namely, the lowermost lug 38 and the uppermost lug 39. When the hammer 5 is rotated from its rest position as shown in FIGS. 1, 8 and 9 to its cocked position as shown in FIGS. 2 and 7, the lowermost lug 38 of the pawl 36 engages a tooth of the cylinder ratchet 22 and rotates the cylinder 3 a distance sufficient to position a new chamber 20 in alignment with the bore of the barrel 2. When the hammer 5 is at rest and the loading gate 16 is rotated from its closed position as shown in FIG. 4 to its open position as shown in FIG. 5, the nose 24 of the cylinder latch is lowered and the cylinder 3 is free to rotate. If rotated in a counterclockwise direction, any chamber 20 may be brought into alignment with the gate opening 53 by trial and error. If the cylinder 3 is rotated in a clockwise direction, the tooth 22a of the cylinder ratchet 22 is rotated to and comes to rest against the uppermost lug 39 of the cylinder pawl 36 as shown in FIG. 10, thereby automatically aligning the chamber 20a with the gate opening 53 as shown in FIG. 11. The chamber 20a can then be loaded or unloaded in the usual manner."

Stone's U.S. Pat. No. 933,797 ('797), patented on Sep. 14, 1909, describes the operation of an improved self cocking (double action) revolver.

The beginning of the first page of the specification of Samual Colt's classic U.S. Pat. No. RE124 reads as follows:

SAMUEL COLT, OF HARTFORD, CONNECTICUT
IMPROVEMENT IN REVOLVING FIRE-ARMS

Specification forming part of Letters Patent No. 138, dated Feb. 25, 1836; Reissue No. 124, dated Oct. 24, 1848. Samual Colt The present invention may also be used with another valuable revolver feature called a "Trigger Cocking Double Action" revolver. The following is from Sturm, Ruger & Company, Inc. home page; click "Revolvers" on the drop down "Firearms" menu.

"Single Action, Double Action or Black Powder?"

"Single action revolvers are so-called because their trigger performs the single action of firing the gun after the hammer is cocked manually. They are simple, rugged, and of classic "old West" design. They are loaded and unloaded one cartridge at a time—slow, but rugged. . . .

"Double action revolvers can be fired like single actions (first cocking the hammer and then pulling the trigger) or in the double-action mode (pulling the trigger through a longer arc, which both cocks the hammer and then fires the revolver). Double Action revolvers are quicker to shoot and reload, as they have a swing out cylinder and simultaneous ejection."

Additional fire arms are described in the Wikipedia free online encyclopedia, for example, by searching the words "trigger (firearms)" and "revolver" and "automatic revolver".

The following is copied from the Wikipedia page found by searching the term "automatic revolver". The underlined words in the following four paragraphs may also be searched on Wikipedia to find additional information about firearms.

"Double action revolvers use a long trigger pull to cock the hammer, thus negating the need to manually cock the hammer between shots. The disadvantage of this is the long, heavy pull that cocks the hammer makes the double action revolver much harder to shoot accurately than a single action revolver (although cocking the hammer of a double action reduces the length and weight of the trigger pull). There is a rare class of revolvers, the automatic revolver, that attempts to overcome this restriction, giving the high speed of a double action with the trigger effort of a single action.

The Webley-Fosbery Automatic Revolver was the first commercial example, introduced in 1901. It was recoil-operated, and the cylinder and barrel recoiled backwards to cock the hammer and revolve the cylinder. It was distinctive in that cam grooves were milled on the outside of the cylinder to provide a means of advancing to the next chamber—half a turn as the cylinder moved back, and half a turn as it moved forward. .38 caliber versions held 8 shots, .455 caliber versions 6. At the time, the few available automatic pistols were larger, less reliable, and more expensive. The automatic revolver was popular when it first came out, but was quickly superseded by the creation of reliable, inexpensive semi-automatic pistols.

In 1997, the Mateba company developed a type of recoil-operated automatic revolver, commercially named the Mateba Autorevolver, which uses the recoil energy to auto-rotate a normal revolver cylinder holding 6 or 7 cartridges, depending on the model. The company has made several versions of its Autorevolver, including longer barreled and carbine variations, chambered for .357 Magnum, .44 Magnum and .454 Casull. The Pancor Jackhammer is a combat shotgun based on a similar mechanism to an automatic revolver. It uses a gas action to move the barrel forward (which unlocks it from the cylinder) and then rotate the cylinder and cock the hammer."

"Iver Johnson made an unusual model from 1940 to 1947, called the Trigger Cocking Double Action. If the hammer was down, pulling the trigger would cock the hammer; if the trigger was pulled with the hammer cocked, it would then fire. This meant that to fire the revolver from a hammer down state, the trigger must be pulled twice."

This Trigger Cocking Double Action may:

(i) Increase rate of fire over single action operation.

(ii) Improve accuracy over double action operation.

Whether a shooter's revolver is a single action or double action, accuracy is superior when operated single action since firing the weapon requires minimal trigger pull after the gun is cocked. However, when a double action is operated single action instead of double, more time is required between successive shots to allow thumb cocking between shots, because, in order to cock the gun with the thumb for the next shot, the palm must move away from the revolver's handle's grip-panel to allow the cocking thumb (which extends from the rear part of the shooter's hand's palm) to rise upwards into position to cock the hammer. After thumb-cocking, the hand's firm grasp on the gun's grip must be reestablished and the gun may then be re-aimed and fired with minimal trigger pull.

When using a Trigger Cocking Double Action revolver, a shooter needn't disturb his grasp of the gun's hand grip to use his thumb to cock to achieve single action like accuracy on a subsequent shot, and therefore a subsequent shot can be taken faster than using the thumb to cock the hammer.

Also, the 1976 movie "The Shootist," which marked the final film role of America's iconic hero, a giant to be admired, John Wayne, is incorporated herein by reference as a general tribute and as a tribute for being the inspiration for the present invention. There's a memorable quote from terminally ill J. B. Books (played by John Wayne), the most celebrated shootist extant: "I won't be wronged, I won't be insulted, and I won't be laid a hand on. I don't do these things to other people, and I require the same from them."

Revolvers are still quite popular. In 2006, for example, Smith & Wesson sold about 153,400 of its 44 different models of revolvers for $64.1 million which came to 27.3% of net sales. Automatic pistols accounted for 33.3% of net sales. Generally, police and military use automatic pistols while hand gun hunters use revolvers.

Who'd have thought, in this day and age of Glocks and tasers, old fashion six-shooters (six-chamber revolvers) could still stand significant safety and functional improvement?

Quoted Merriam Webster dictionary definitions below are for reference only and are not meant to be limiting:

Main Entry: re•volv•er
Pronunciation: ri-'väl-v&r, -'vol- also -'vä-v&r or -'vo-v&r
Function: noun
Date: circa 1835
. . . 2: a handgun with a cylinder of several chambers brought successively into line with the barrel and discharged with the same hammer
Main Entry: machine gun
Function: noun
Date: 1867
: a gun for sustained rapid fire that uses bullets; broadly: an automatic weapon
Main Entry: gun-smith
Pronunciation: -"smith
Function: noun
Date: 1588
: one who designs, makes, or repairs small firearms
-gun•smith•ing /-"smi-thi[ng]/noun)
Main Entry: ma•chin•ist
Pronunciation: m&-'shE-nist
Function: noun
Date: circa 1706
1 a: a worker who fabricates, assembles, or repairs machinery b: a craftsman skilled in the use of machine tools

SUMMARY OF THE INVENTION

The present invention comprises systems, methods, mechanical elements and apparatus including control elements, buttons, slide latches, springs etc. to be positioned by the shooter to set a retainer to prevent the pawl from rotating the cylinder when recocked and positioned by the shooter to reset a retainer to allow the pawl to rotate the cylinder to improve the possible operation of a single action or double action hand gun revolver and or shoulder gun revolver (as opposed to a machine gun or semi-automatic pistol) that can be operated as single action, i.e., e.g., typically using the thumb to cock the weapon (i.e., e.g., pull the hammer back from the at rest position to be held or retained, by means built into the revolver, in the firing position) and subsequently (thereafter) pulling the trigger to fire. Revolvers of this type are generally described on the Wikipedia page found by searching the term "revolver".

The improvement comprises ways and mechanisms to improve the operation of what is commonly called the cylinder pawl (or hand) and associated gun parts. Typically, the cylinder pawl in single action revolvers is connectively operated on a pin or stud by the hammer; the cylinder pawl in double action revolvers is connectively operated on a pin or stud by the trigger. Typically, in either action, the pawl is in a lower disengaged from the cylinder ratchet position when the hammer is down in the uncocked position. Typically, in either action, the pawl rises engaging a tooth on the cylinder indexing ratchet advancing the cylinder one chamber as the revolver is cocked—by the hammer in a single action, and by either the hammer or the trigger in a double action—and the pawl remains so engaged while the revolver remains cocked.

The improvement may be retrofitted or incorporated during the manufacturing process of various revolvers such as Smith & Wesson®, Ruger®, Charter Arms® and Colt® revolvers.

Various websites show revolvers with cartridge cylinders having chambers in the cylinder to typically hold 6 rounds more or less.

The present invention comprises ways and mechanisms to prevent the cylinder from advancing upon being recocked should the revolver be cocked a first time and purposely uncocked (decocked) without firing after the first cocking.

Embodiments of the present invention comprise an improvement comprising added mechanical control elements to prevent the cylinder from advancing to the next chamber under certain circumstances. According to embodiments of the present invention, upon recocking after purposely decocking, the cylinder does not advance. For example, the cylinder ratchet is not engaged and advanced by the pawl thereby advancing the cylinder and skipping a live round upon recocking after decocking.

Various embodiments include, for example, manual control for positioning, e.g., a control push button, knob, slidable latch cam, slide element, etc. operated by the shooter associated with decocking or after decocking to set (or engage) the cylinder advance prevention mechanism (element), for example, a retainer, either directly or through linkage that may include a one or more springs and be may be spring loaded, or automatic control operation while decocking to engage the cylinder advance prevention mechanism, for example, a retainer, either directly or through linkage, and manual and automatic ways to disengage the retainer mechanism are disclosed, and other embodiments will become evident to those skilled in gun smithing and related machinist arts.

Suppose, for example, a revolver has only one live round (remaining, e.g., after shooting those in the other chambers) in a chamber which is in the cylinder position that would advance and fire next upon cocking with a finger (e.g., the thumb) and, if the trigger were pulled, the weapon would then fire (i.e., discharge, to shoot the gun) the one live round in the normal manner.

Using this example, however, suppose the shooter cocks the revolver a first time advancing the cylinder with the one live round to the firing position but then the shooter decides not to shoot and therefore no longer wants the revolver in the cocked position ready to fire. Typically, if the shooter were to let the hammer down softly, gently, so as not to discharge the gun, i.e., uncock (also called decock) the weapon, the one live round would no longer be in a chamber in the cylinder position that would advance to the firing position upon a second cocking (or recocking)—if the trigger were pulled after the recocking, the gun would not fire because the one live round would have advanced past the firing position.

As will be readily apparent to gunsmiths, e.g., one skilled in the art who designs, makes, or repairs small firearms, and machinists skilled in related gunsmith art, the present invention is, of course, useful no matter how many live rounds are loaded in adjacent chambers of the weapon's cylinder (there's one exception, i.e., it is not as useful or not useful at all when all chambers are loaded because it would be impossible to skip a live round when recocking), so that, under typical circumstances, all live rounds are in position to be fired one after the other no matter how many are yet to be shot (unfired, not yet discharged, unspent) each time the revolver is cocked. For clarity purposes and ease of explanation, the example discusses a revolver with only one remaining live round in a chamber in the cylinder position that would advance and fire next upon cocking and pulling the trigger.

According to various embodiments of the present invention, mechanical means or components are added to the revolver to be set (to prevent cylinder rotation when recocked) and reset (to allow cylinder rotation when recocked) by the shooter. For example, by moving or pressing a control element such as a depressible button or knob or other control element, or by sliding a slidable latch control element, or otherwise moving or operating a settable mechanism, before slowly letting the hammer down, or while letting the hammer down, or after letting the hammer down, a mechanical retainer mechanism according to embodiments of the invention will be set (or engaged) in order to prevent the cylinder from rotating the next, and only the next, time the hammer is cocked and the trigger pulled to fire the weapon.

According to various embodiments of the present invention, the cylinder may be prevented from rotating even after repeated cocking and decocking. In some embodiments, the added mechanism must be reengaged if the revolver is decocked again after recocking. After firing, added mechanism will automatically allow the cylinder to rotate normally, or the added mechanism can be reset manually by the shooter to allow the cylinder to rotate normally. That is, the settable control element may also be resettable by the shooter to disengage the retainer so the pawl advances the cylinder when the revolver is recocked by positioning the control element to the reset (disengaged) position.

If the weapon is also able to function as a double action revolver, i.e., e.g., pulling the trigger cocks the hammer while also advancing the cylinder and, after the hammer and cylinder are positioned for firing by pulling the trigger far enough, the hammer will be released to fire the weapon, embodiments similar to those above are possible. Pulling the trigger after the hammer has been slowly decocked cocks the hammer but does not advance the cylinder, so that, after the hammer is positioned by the trigger for firing, and the cylinder still being in a position for firing, pulling of the trigger further releases the hammer to fire the weapon.

The added mechanisms may be set and reset by the shooter, for example, with a slidable sliding latch similar in some regard to the cylinder thumb latch release as previously depicted in Picture 2 (shown in the provisional patent application), which was an enlargement from a section of Picture 1 (also previously shown), or some other control elements or apparatus on the frame or elsewhere on the weapon, or the added mechanisms may be operated by the shooter with the added control element button shown in FIGS. 1, 2, 4, 5 and 6, or the slide latch control element shown in FIG. 6*a*, as described below. The button or slide control elements shown and described below may be mounted on the either side of the revolver or elsewhere on the revolver.

A revolver, having a hammer, a trigger, a rotating cylinder with chambers therein and ratchet teeth, and a cylinder rotating mechanism including a pawl that engages a ratchet tooth on the cylinder to cause the cylinder to rotate one chamber as the revolver is cocked in response to a shooter pulling the hammer in a single action revolver or in response to either pulling the hammer or pulling the trigger in a double action revolver, according to some embodiments of the invention as claimed, also comprises a settable and resettable retainer that is set in association with or following a decocking after a first cocking. The retainer when set preventing the pawl from engaging a cylinder ratchet tooth and rotating the cylinder when the revolver is recocked, and when reset permitting the cylinder to rotate when the revolver is recocked.

Also according to some embodiments of the invention, the revolver may comprise a control element coupled to the retainer which sets and resets the retainer in response to positioning the control element, the control element being accessible to the shooter for setting and resetting the retainer.

Further according to some embodiments of the invention, the revolver may comprise a control element coupled to the retainer and to the cylinder ratchet mechanism, the control automatically setting the retainer in response to movement of the cylinder ratchet mechanism in association with decocking.

Still further, the retainer may be coupled to the cylinder rotating mechanism and be automatically reset in response to the revolver being recocked, or the retainer may be automatically reset in response to firing recoil of the revolver.

Additionally, according to some embodiments of the invention, the control element may be a depressible button which sets and resets the retainer in response to the shooter positioning the button, or the control element may be a slidable latch which sets the retainer in response to the shooter positioning the latch.

BRIEF DESCRIPTION OF THE DRAWINGS

Some revolver parts (or components, or elements) shown in the Figures are shown in different relative scale compared to other parts for illustration and description clarity; i.e., not all parts in are shown to the same scale. Parts shown and/or described for one embodiment or one Figure may be combined with parts shown and/or described for other embodiments or Figures.

The added parts according to embodiments of the present invention in all Figures are identified with three digit numbers. The Figures herein show improved generic gun parts, components, to which have been added elements according to embodiments of the present invention which may with or without modification be added to various brands and models of revolvers. Most Figures show embodiments wherein the shooter positions the manual control element to set and reset the pawl retainer to prevent (while set) or to permit or allow (while reset, or un-set) the pawl to rotate the cylinder.

Figure 1:
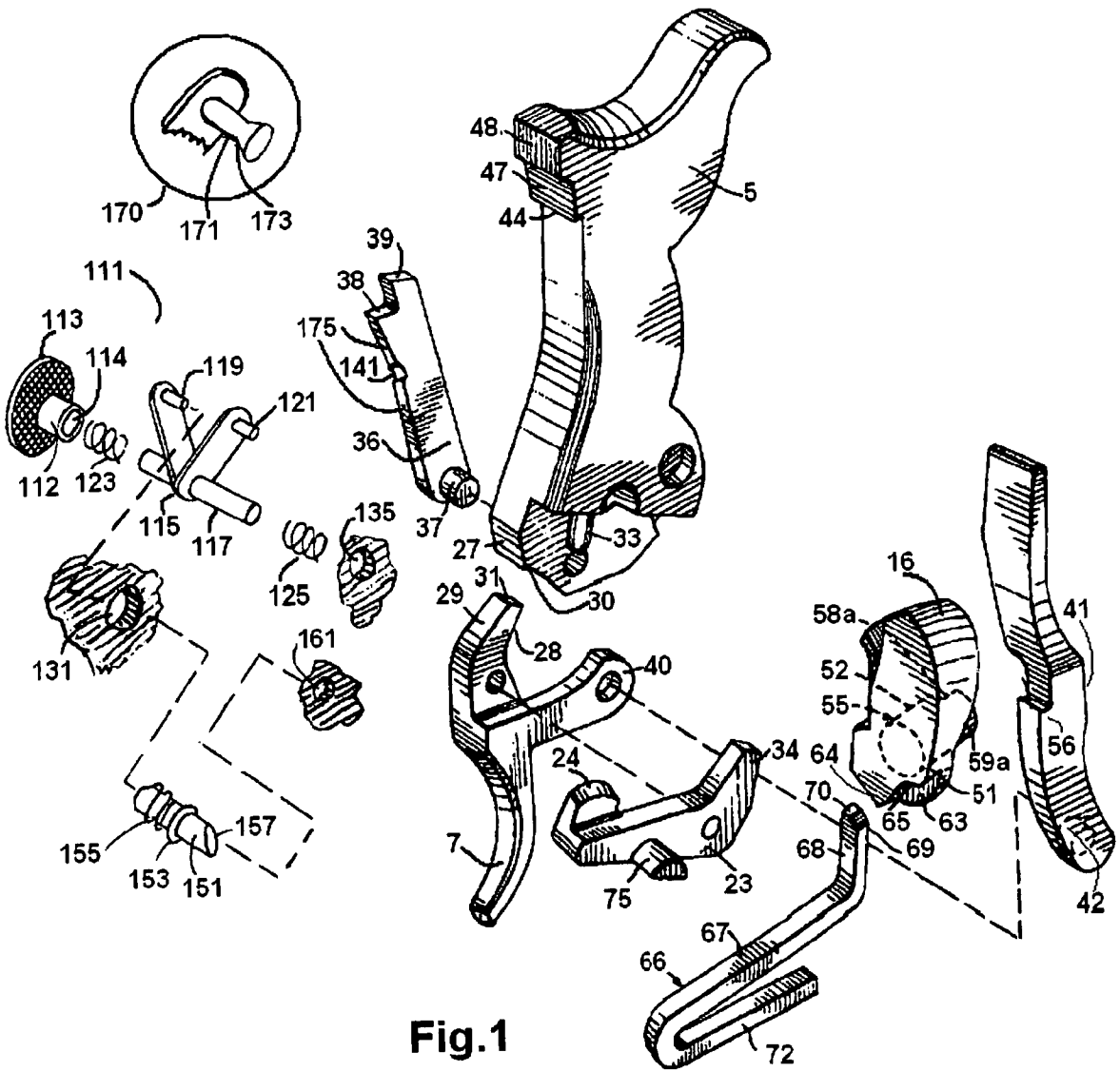
FIG. 1 incorporates in reverse image FIG. 3 from Ruger et al's. U.S. Pat. No. 3,768,190 combined with parts and their numbering according to an embodiment of the present invention. The numbered parts in Ruger et al's. '190's FIG. 3 are two digit numbers as shown in the embodiment in FIG. 1 of the present invention.
Figure 2:
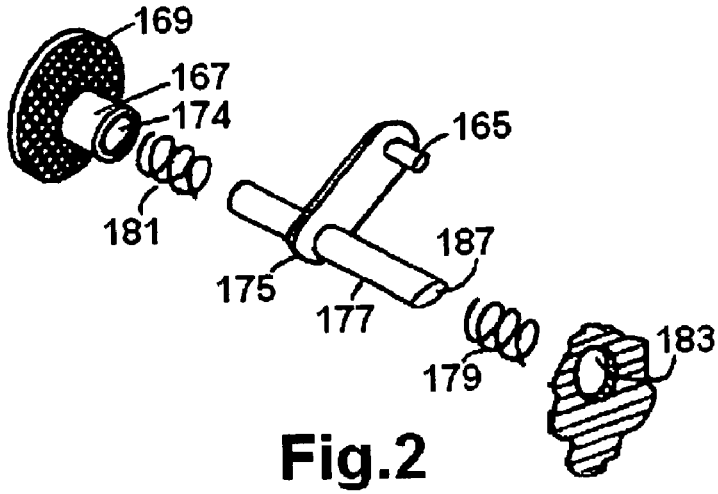
Figure 4:
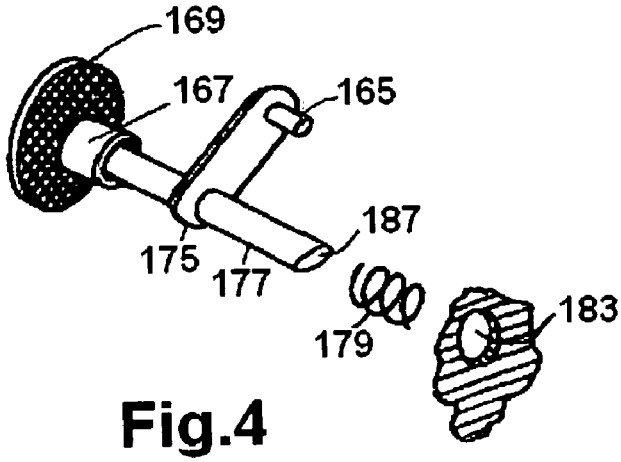

FIGS. 1, 2 and 4 show a control element that is a depressible button which sets and resets the retainer in response to the shooter positioning the button.

Figure 3:
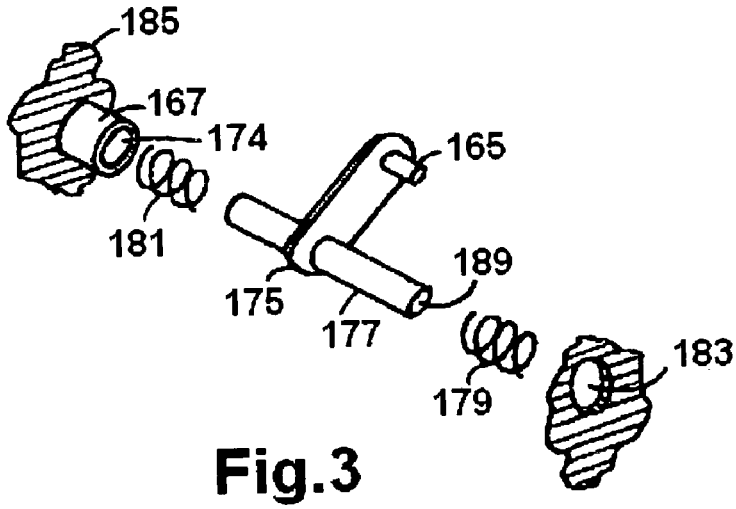

FIG. 3 shows an automatic embodiment that sets the retainer during decocking (without the shooter positioning a control element). In this embodiment, provision is made for the shooter to reset the retainer and allow cylinder rotation when recocked in the event of a misfire.

Figure 5:
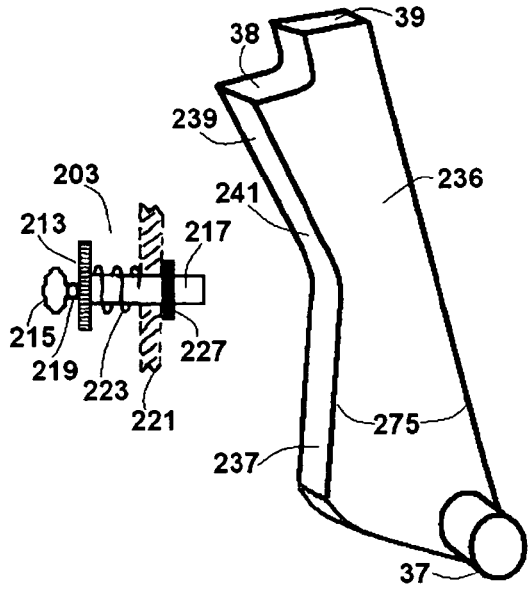
Figure 7:
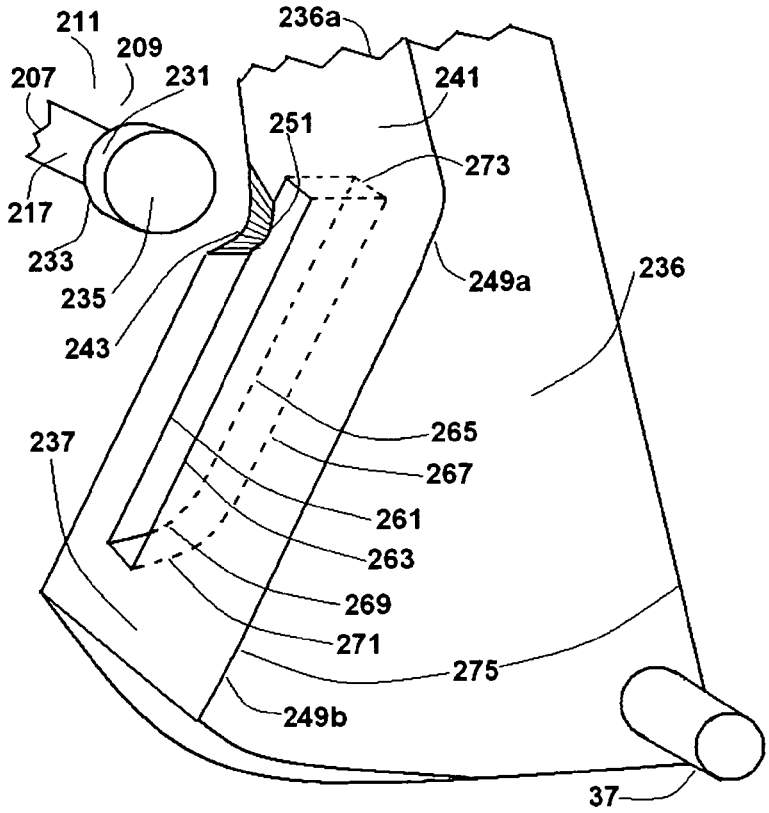
Figure 6A:
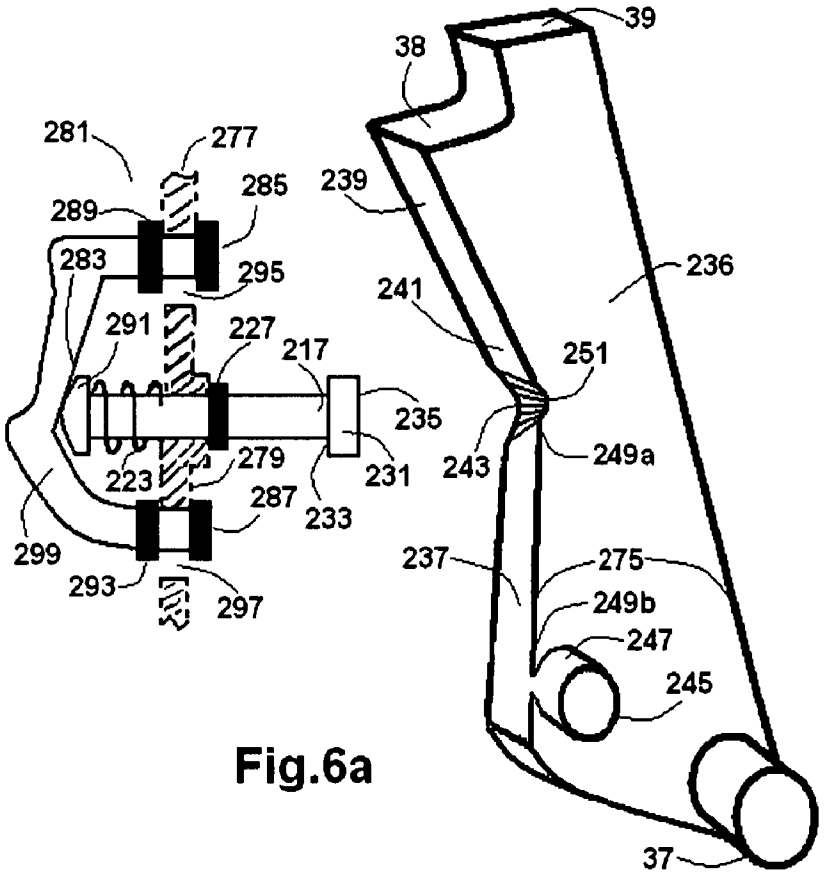
Figure 6:
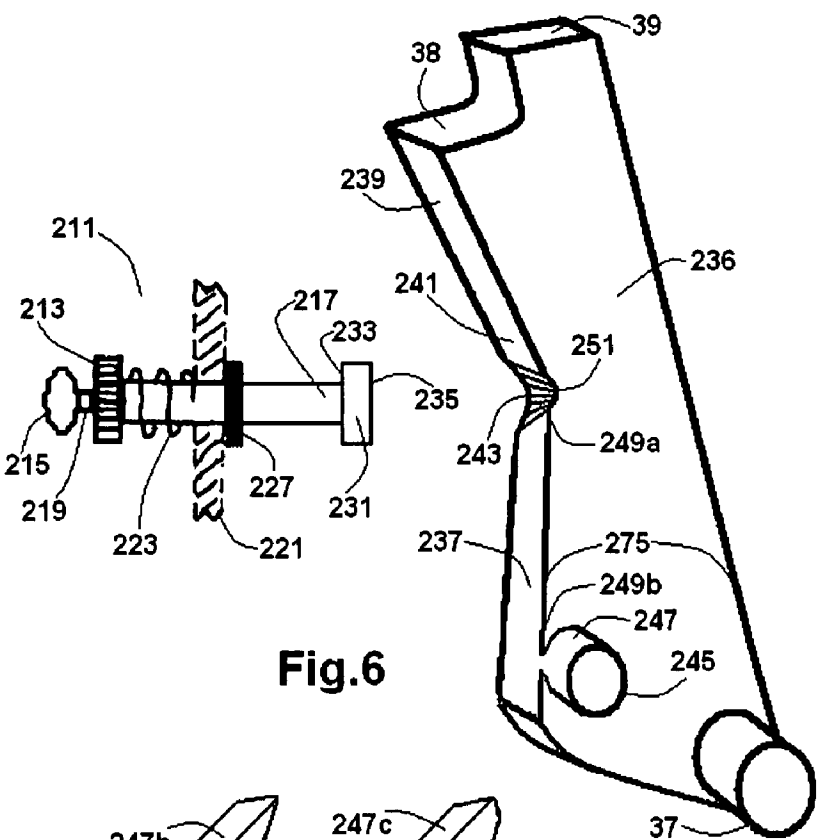

FIGS. 5 to 7 have been added since the provisional application was filed.

FIGS. 5, 6 and 7 illustrate improved generic gun parts and a modified pawl with a widened lower portion depicted in the Figures by the expanse or spread of 275 on lower portion 237 of pawl 236 according to embodiments of the present invention which may with or without further modification be added to various brands and models of revolvers. In FIG. 5, the added control element with knob 215 and spring loaded element 213 of assembly 203 according to an embodiment of the invention is manually positioned (in this embodiment, pushed in and held in) by the shooter to retain the pawl during recocking so that as the pawl rises, it is prevented from engaging the ratchet tooth on the cylinder.

In the embodiments depicted in FIGS. 6, 6*a* and 7, the shooter sets the nail head shaped retainer after decocking and before recocking. When the retainer is set, the cylinder of the revolver will not advance to the next chamber when recocked. Recocking automatically resets the retainer by, for example, the added pin stud 245 in FIG. 6 and by the channel 273 recessed or indented into the pawl in FIG. 7, the retainer being urged or positioned to reset position by spring loaded urging provided by spring 223 between retainer control element 213 and, for example, the frame shown as 221 in FIG. 6. Thus, after recocking, the cylinder will advance the next time the revolver is cocked (unless the shooter sets the nail head retainer again as he/she might want to do after another decocking).

Figure 6C:
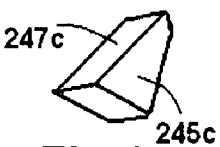
Figure 6B:
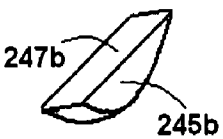

FIG. 6*a* depicts a slidable latch to be positioned by the shooter. The retainer latch assembly control element depicted in FIG. 6*a* is minimally susceptible to being inadvertently set. As the shooter slides the latch, its inside slanted latch surface pushes the rounded surface 291 of the retainer so that nail shaped head 231 traverses past slanted groove 243, 251 in the pawl to allow the retainer to be set (the shooter may hear and/or feel a faint "click" as the pawl is urged forward hitting the shaft of the nail under the nail head when the retainer is set) as described below. The nail head shape of retainer will be automatically reset as the pawl rises to its upper position by being pushed flush with pawl surface 237 by added pin stud 245 (or, as shown in FIGS. 6*b* and 6*c*, the surfaces 247*b* or 247*c* of differently shaped studs 245*b* or 245*c*) allowing spring 223 to reset the retainer by pushing the retainer's rounded surface 291 against inside slanted latch surface 283 causing the latch to automatically slide to the reset (un-set) position.

FIG. 7 depicts a recess or channel in a pawl which automatically resets the retainer when the revolver is recocked.

Figure 8:
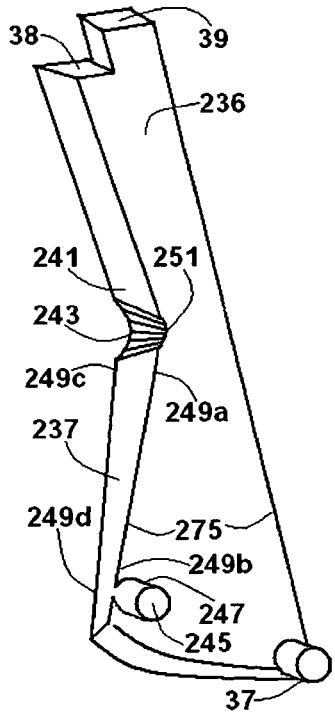

FIG. 8 shows a pawl with a beveled surface 237 which may be useful in various embodiments in association with setting and/or resetting the retainer.

Figure 9:
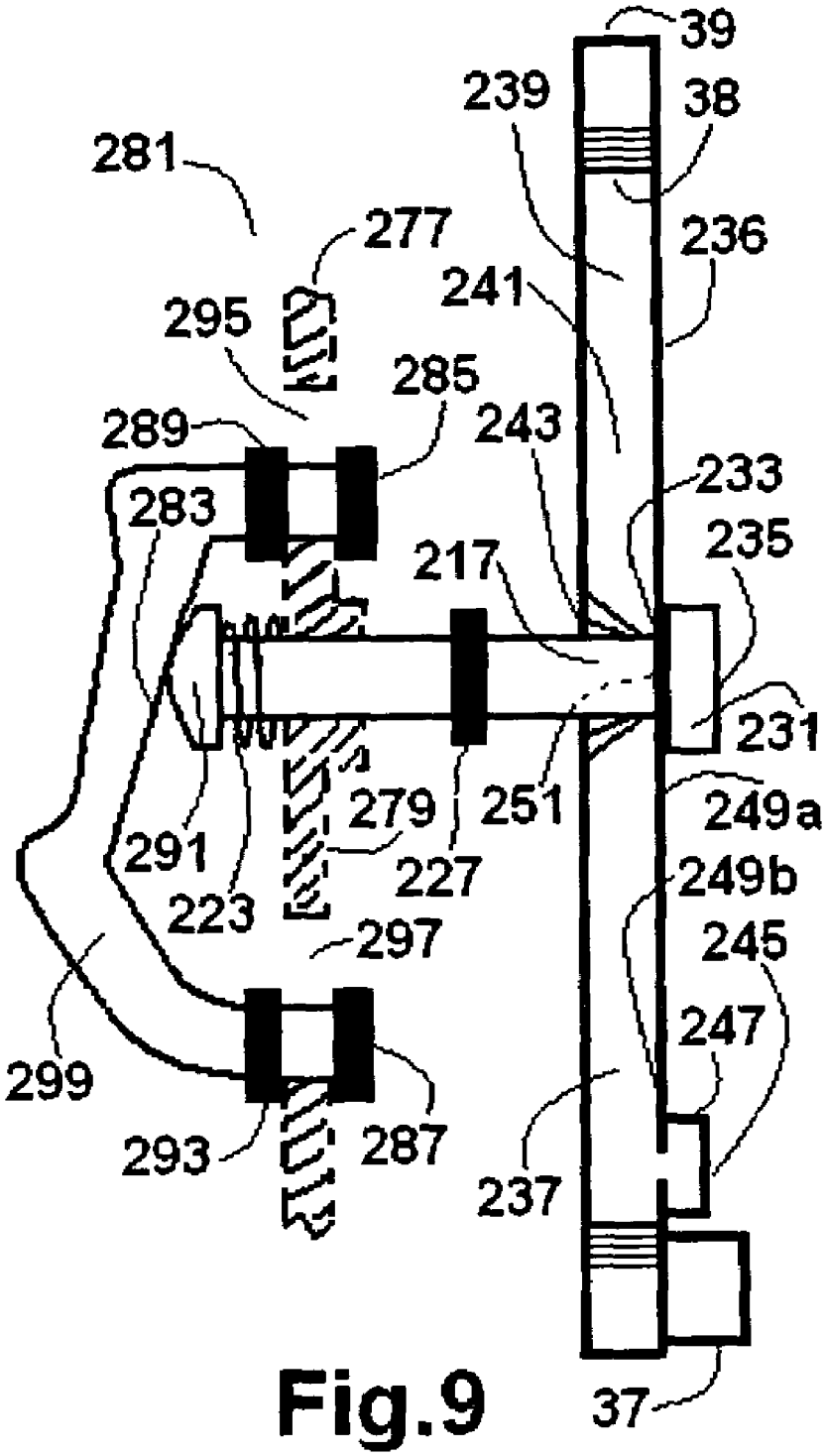

FIG. 9 has a different perspective view of pawl 236 shown in FIG. 6*a*. FIG. 9 shows the retainer latch assembly 281 shown in FIG. 6*a* in the "set" position.

In some embodiments described herein and illustrated by some of the Figures, in a double action revolver, the hammer and the trigger are decocked (meaning the hammer is let down and the trigger is released to its forward position) in order to set the retainer because, as mentioned above, typically, the cylinder pawl in double action revolvers is connectively operated on a pin or stud by the trigger (not the hammer). In a double action revolver, decocking means letting the hammer down and releasing the trigger to its forward position.

Picture 1 previously (shown in the provisional patent application) showed a picture of the thumb slide latch mounted on the exterior of the frame of a S&W Model 36 revolver so a shooter holding the revolver in his right hand could operate the slide latch with is right hand's thumb in order to release the cylinder.

Picture 2 previously showed an enlargement from a section of Picture 1 of the thumb slide latch located on the outside of the revolver so as to be slid or pushed forward (sideways) by the shooter to unlatch the cylinder to allow it to swing out for emptying spend cartridges and reloading.

Picture 3 previously showed a small picture of the thumb slide latch side view of a S&W Model 36 revolver with a 3 inch barrel.

DETAILED DESCRIPTION

The descriptions use by way of example a revolver with only one remaining live round in a chamber in the cylinder position that would advance and fire next upon cocking a first time and pulling the trigger.

Referring to FIG. 1, to set and reset the added mechanism, shown generally as added means 111, the shooter pushes control button 113, which may be accommodated in a hole or other suitable aperture associated with the frame or body or other part of the revolver. A lip or flange like ring (not shown) around the right-hand side (non-button side) of hollow shaft 112 limits button 113's travel when the button is released.

Various control elements other than a button may be used by the shooter to position or operate the added mechanisms, for example, a suitably sized knob may be pushed in to set (engage) the pawl retainer and pulled out to reset (disengage), or a generally round cam on a suitable axis may be rotated by the shooter's thumb or other wise, or a slide similar to the thumb slide latch previously shown in pictures 1 to 3 (of the S&W Model 36 Revolver, as mentioned above, to unlatch the swing-out cylinder for loading) may be positioned (moved or operated) by the shooter, etc. A latch slide, such as, for example, latch 299 in the retainer assembly 281 shown in FIG. 6*a*, may be accommodated in a suitable slot to allow it to move sideways and/or up and down and it may be associated with, for example, a flat, rounded or contoured angled cam surface that may provide a prescribed motion that is accommodated by a suitable follower, i.e., the output link of a cam mechanism, such as depicted by retainer rod 217 rounded spring loaded plunger head 291, the other end of which rod 217 is shown as nail shaped retainer head 231 in FIG. 6*a*, and as is known by those skilled in the arts. The detailed description below will focus on the shooter operating the added means by use of a control button such as shown generally in the added means 111 in FIG. 1.

Button 113 may be positioned to be set by pushing and temporarily held by the shooter toward the gun frame, typically with the hand not holding the gun, while slowly decocking the gun (i.e., gently letting the hammer down so as not to discharge a round) typically with the thumb of the gun hand controlling the hammer while the gun hand trigger finger pulls the trigger to release the hammer and also to allow the trigger to be released to go to its fully forward position.

The push-button 113 may ride on pin axel 117 compressing spring 123 and pushing boomerang part 115 which slides on the center of boomerang 115 as shown on pin axel rod 117 to boomerang 115's activated or "on" or "set" position. The inside (non-cylindrical) surface of hollow shaft 112 may cooperate with spring 123 by pushing on the left end of axel 117 to push boomerang 115 so that retainer 121 engages pawl notch 141. As depicted in FIG. 1, boomerang part 115 may be fashioned out of one solid piece or two boomerang arm pieces may be joined and fastened together, to become the central portion of the boomerang part 115 that rides on pin 117. If boomerang part 115 is fashioned out of two boomerang arm pieces and joined and fastened together, that boomerang part 115 so fashioned would function the way a boomerang part 115 fashioned out of one solid piece would function.

The pin axel 117 shaft may be solid; the shaft 117 is shown round, but, for example, a square shaft (not shown) (or some other shaped shaft) with square end accommodations are also possible. A square shaft could prevent boomerang part 115 from rotating on the shaft and this design may be suitable or preferred for use in some revolvers as could be determined by a gunsmith. A square (or polygonal) shaft in another example that was twisted one end to the other a predetermined amount, so that the cross-section at one end could be offset some number of degrees from the cross-section at the other end, could be used to cause the boomerang part 115 to rotate as it moves to and fro on the pin axel shaft 117. The number of degrees in the twist from one end to the other could, typically, be nominal, as determined by a gunsmith for a particular revolver design.

Button 113's shaft 112 may be hollow 114 as shown to accommodate one end of pin axel 117 (shown in FIG. 1 as the left end of pin axel 117). Pin axel 117 is furthest into button 113's hollow 114 when retainer 119 is not held by temporary retainer 131 (shown, as may other parts be shown, to a different scale than other parts), and not as far into button 113's hollow 114 when retainer 119 is held by temporary retainer 131 as described below. There may be an accommodation 135 described below for the other end (shown as the right end) of pin axel 117, i.e., the end that is not into the hollow 114 of button 113's shaft. Pin axel 117 may be fixed rigidly in accommodation 135 by adhesive means, mechanical means such as threading on the right end of pin axel 117 which may be screwed tight into accommodation 135, friction means (banged into a tight fit that will hold it), by welding, hot glue or by some other fastening means. Temporary retainer 131 and accommodation 135 are built or molded in or cut in or in some other way associated with the frame or body or other part of the revolver.

Or boomerang 115 may be fixed on axel 117 which may be fixed (as described above) into hollow 114 of shaft 112 and slide to and fro in accommodation 135; with this arrangement (spring 123 would not be needed), if control button 113 were pushed in to cause engagement of retainers 119 and 121 with temporary retainers 131 and pawl notch 141 as described below, button 113 would stay in until disengagement occurred (e.g., by recoil) or until manually disengaged by the shooter pulling button 113 out or by some other means at which point the retainers 119 and 121 would be "un-set" or "reset." Pulling button 113 out could manually disengage retainers 119 and 121 from temporary retainer 131 and pawl notch 141. Manual disengagement or resetting by the shooter would be desirable or required in the different embodiments described below or otherwise, for example, after a misfire (failure to fire) due to a dud (defective round that did not discharge (fire)).

As a gunsmith or another skilled in the art would know, alternate mechanical arrangements are possible. For example, since boomerang 115 slides on pin axel 117, the left end of pin axel 117 may be fixed into button 113 and the right end of pin axel 117 could slide to and fro in accommodation 135. For another example, boomerang 115 could be fixed fast to pin axel 117, and both ends of pin axel 117 could slide in their respective end hollow or accommodation housings, i.e., e.g., the left end could slide to and fro in button 113's shaft 112 and the right could correspondingly slide in accommodation 135. Embodiments described in association with FIGS. 2, 3 and 4 use one arm, not two arms as shown in FIG. 1 as boomerang 115 with an arm with a pin stud 119 and another arm with pawl retainer 121. The use of two arms, e.g., the second arm with stud 119, may provide improved design flexibility and greater construction options to suit a larger variety of revolvers.

Spring 123 rides around pin axel 117 pressing against button 113 on the left, holding it in the out position when it is not being pressed by the shooter, and on boomerang 115 on the right. Spring 125 rides around pin axel 117 pressing against boomerang 115 on the left and accommodation 135 on the right.

Temporary retainer 131 depicted in FIG. 1, may be adapted by gunsmiths and those skilled in the art as required to different brands of revolvers, and adapted to different models of those brands as required. Accommodation 135, depicted in FIG. 1, will also be adapted by those skilled in the art as required to different brands of revolvers, and adapted to different models of those brands as required.

Pin stud 119 on one end of boomerang part 115 may engage and be held by, for example, friction by temporary retainer 131, as pin stud cylinder pawl retainer 121 on the other end of boomerang part 115 moves into position in pawl notch 141 to hold against and temporarily retain a cylinder pawl such as pawl 36 (taken from FIG. 3 of U.S. Pat. No. 3,768,190 which is shown by way of example) as shown in FIG. 1, and such as the various cylinder pawls shown in each of FIGS. 1 to 8 in U.S. Pat. No. 6,385,888. A pawl notch, such as 141 in accordance with an embodiment of the present invention, is shown as a modification to pawl 36 in FIG. 3 of the '190 patent. Typically, the pawl notch 141 may be shallow to allow the pin stud cylinder pawl retainer 121 to slide in and out and or up and down and or to pass over (e.g., slide over) notch 141 from either direction depending on the particular implementation design for different brands and models of revolvers.

In some of embodiments of the present invention described herein, recoil from firing the weapon will allow parts held by friction to become disengaged. Weapons with more recoil may allow disengagement more readily than those with less recoil.

Although embodiments discuss the present invention by way of example using pawl 36 shown in FIG. 3 and other Figures of the '190 patent, as would be apparent to a skilled artisan, the several modified pawls and modified revolver parts associated therewith, and their modified paths of upward travel, downward travel and their line of travel, shown and described in the '888 patent, "Revolver firing mechanism with disengaging cylinder pawl," may be used and or modified further to benefit some of the embodiments described for the present invention; e.g., to benefit the disengagement and or the engagement of pawl retainer 121 and pawl notch 141 and other added parts.

Pin stud cylinder pawl retainer 121 may be partially (wide or narrow end) cone shaped at the end, or some other shape, as opposed to being a straight pin stud. For example, an alternate pin 171 (shown at exaggerated length) for pin stud 121 is shown in cutout 170; cone shape end 173 depicts the wide end of a cone shape at the end of alternate 171. If a design similar to alternate pin 171 is utilized, a correspondingly accommodating shape may be incorporated into the edge 175 of pawl 36 to more comfortably accommodate cone shape end 173 of alternate pin 171. Accommodating edge 175 may extend above and or below shallow notch 141 in pawl 36. Cone end alternate pin 171 may be used to, e.g., aid temporarily retaining cylinder pawl 36. The use of alternate shapes like a cone shape may tend to require more or less recoil for disengagement to occur to allow the pawl to advance the cylinder after firing. Other ways to require more or less recoil include, e.g., using various textured or slippery surfaces, etc.

Storch et al. U.S. Pat. No. 4,051,487 describes oblique angles and edges that may be adapted to cooperate with alternate pin 171 of FIG. 1 herein. For example, column 3, lines 36 to 51 of the '487 patent read as follows:

"As the slide continues to move from its intermediate position (FIG. 5) to its locked position (FIG. 6), the stem of rivets 41 passes from the bottom to the top of the upper parallel sections 52a of cam slots 52 so that the slide moves in a path parallel to the edge of the film. However, slide 46 includes upper and lower pin engagement edges 46b, 46c which are angled obliquely with respect to the direction of travel of the slide as it moves between the intermediate position (FIG. 5) and the locked position (FIG. 6). The angle and length of these engagement edges are selected so that as slide 46 moves downwardly between the intermediate position and the locked position, edge 46b comes into contact with pin 32, while edge 46c substantially simultaneously comes into contact with pin 34, rigidly locking the font in position."

And column 3, lines 59 to 64:

"Note also, that the engaging edges 46b and 46c of the slide 46 are preferably beveled so that the angled portion of the engaging edges tightens against the ball at a position lower on the ball than would occur without the bevel providing a greater and more stable contact area between the edges and the ball."

FIG. 8 depicts a modified pawl 236 according to an embodiment of the invention. Surface 237 is beveled, for example, as shown, the edge between 249*a* and 249*b* is not parallel to edge 249*c* and 249*d*. As the pawl 236 is raised by cocking and lowered by decocking, the twisted or oblique beveled surface 237 will cause contact between it and, for example, alternate pin 171 for pin stud 121, of the retainer assembly in FIG. 1, to change or vary. This beveled surface 237 feature may be used as shown, or combined with other features described, to set and/or reset the retainer, or aid in setting and resetting the retainer, for example, to hold the retainer set or to release the retainer to reset. Certain other features in FIG. 8 are described below in association with like numbered elements depicted in other Figures.

Pin stud cylinder pawl retainer 121 (or an alternate) functions to prevent the revolver's particular cylinder pawl (shown as pawl 36) from engaging the cylinder ratchet tooth when the gun is next cocked (recocked). The orientations and shapes of boomerang 115, retainer 119, retainer 121, temporary retainer 131, accommodation 135 and pawl notch 141 are shown by way of example in FIG. 1. Parts such as pawl retainer 121, pin stud 119 and boomerang part 115 will be adapted by those skilled in the art as required to different brands of revolvers, and adapted to different models of those brands as required.

Spring 123 may be designed and selected to naturally stretch (extend, elongate) and cooperate with the friction between retainer 119 and temporary retainer 131 to hold retainer 119 and to push button 113 out (depending on which of different possible implementations are employed) after the shooter releases button 113. Springs 123 and or 125 may provide a twisting action as does, e.g., a torsion springs which tends to produce rotation so as to provide rotational urging to the one arm or to the boomerang with two arms (torsion springs typically operate mouse traps and bear paw traps (the inhuman, cruel variety)). Improved design flexibility may also be provided if, e.g., springs 123 and or 125, provided both pushing tension and twisting tension (rotational urging). Spring 125 may be designed and selected to stretch to overcome spring 123 in order to push and hold boomerang 115 directionally toward button 113 when retainer 119 is released from temporary retainer 131 by recoil or other means as described below.

Several embodiments are described below with only one remaining live round. As will become apparent to skilled artisans and those skilled in related arts, various functions and operations described for one embodiment herein may also benefit and cooperate with other embodiments. Further, as will also become apparent to those skilled in gun smithing and related machinist arts, some embodiments described herein may be more or less suitable for a single action revolver where the pawl typically rises and lowers with the movement of the hammer and some embodiments may be more or less suitable for a double action revolver where the pawl typically rises and lowers with the movement of the trigger. Differences include, for example, that the pawl typically drops quickly in a single action revolver as the hammer is released by the shooter pulling the trigger to fire the weapon—the pawl lowers with speed corresponding to the hammer dropping, while in a double action revolver the pawl typically lowers with speed corresponding to the speed at which the shooter releases the trigger after firing the gun.

In an embodiment (A) the gun may be cocked, decocked with control button 113 held in, cocked again (recocked) and then fired:

a. cock
b. decock using button 113
c. recock
d. fire cylinder advances when next cocked The gun in this embodiment may be fired after being cocked and decocked (uncocked) a first time by the shooter-operator holding in control button 113 while decocking in accordance with an embodiment of the present invention as described above so that retainer 119 will engage temporary retainer 131 and retainer 121 will engage pawl notch 141 and retain pawl 36 so that when the weapon is cocked again cylinder pawl 36 will not engage the cylinder ratchet tooth and therefore will not advance the cylinder so that the one remaining round will stay in place. When cocked again (second cocking, or recocked) and this time fired, retainer 119 may be released from temporary retainer 131 by the recoil and boomerang 115 is pushed by spring 125 compressing spring 123 so that retainer 121 disengages from cylinder pawl 36 so that, when next cocked, pawl 36 will engage the tooth on the cylinder ratchet and rotate the cylinder one chamber normally.

When the hammer is cocked again, hammer latch plunger 33 momentarily contacts and rotates the arm 34 of the cylinder latch 23 which, in turn, momentarily withdraws the nose 24 of the cylinder latch from engagement with the lowermost notch 21 of cylinder 3 which are shown and described, for example, in Ruger et al's. '190 patent in association with FIGS. 1 and 2. Insofar as there is no rotational urging applied to the cylinder from cylinder pawl 36 in accord with an embodiment of the present invention or from extraneous means or else wise, while this momentary withdrawing of nose 24 of the cylinder latch occurs, the cylinder will remain in place and, after the momentary withdrawal, the nose will reengage lowermost notch 21 of the cylinder 3.

In this and other embodiments of the present invention described herein, as may be seen by those skilled in gun smithing and related machinist arts, it may be desirable in some models of some brands of revolvers to make additional mechanical provision in implementing one embodiment or another of the present invention to prevent nose 24 from disengaging while recocking after decocking (uncocking) according to an embodiment of the invention, or, for example, it may be desirable to retard, for example, frictionally retard, cylinder 3 from rotating as freely as it may otherwise, i.e., e.g., incorporate rubbing means (not shown) to rub against cylinder 3 so that cylinder 3 has additional tendency to remain in place when nose 24 momentary withdraws from the lowermost notch 21 of cylinder 3. Consideration must also be given to the shooter accidentally causing cylinder rotation in association with or at the same time as operating or positioning any control elements or parts coupled to the retainer used to set the retainer to prevent the cylinder from advancing to the next chamber when recocked after decocking or resetting the retainer to allow rotation when next cocked.

In this embodiment (A) the gun may be cocked, decocked with button 113 held in, cocked again and uncocked without using button 113 again; in this embodiment the means to inhibit cylinder rotation when cocked a third time remain engaged so the cylinder does not rotate during the third cocking (or additional cockings after additional decockings):

a. cock
b. decock using button 113
c. recock
d. decock
e. recock
f. fire cylinder advances when next cocked If the gun is not fired, but instead the hammer is again decocked (a second time) but not using the 113 button this second decocking time, temporary retainer 131 does not release retainers 119 and 121 does not disengage cylinder pawl 36 so that, when next cocked (thrice cocked), pawl 36 will not engage the cylinder ratchet and will not rotate the cylinder so that the one live round remains in position to be shot. As described, the shooter does not need to push button 113 more than once even if he cocks and decocks the weapon more than once. Please note that the shooter may, if he desires, hold button 113 during additional decockings; it doesn't hurt or change anything. In this embodiment, the revolver can be decocked (uncocked) multiple times, over and over cocked and decocked, and the live round would stay put for firing when the shooter is ready to fire the gun, or not (he can also decock, unload and put the gun away).

In another embodiment (B) the gun may be cocked, decocked with control button 113 held in, cocked again and decocked again but in this embodiment button 113 must again be used in order to keep the means to inhibit cylinder rotation engaged so the cylinder does not rotate if cocked a third time after being decocked a second time:

Not using button 113 a second time:

a. cock
b. decock using button 113
c. recock
d. decock (not using button 113)
e. recock
f. no fire (one live round skipped)

Using button 113 a second time:

a. cock
b. decock using button 113
c. recock
d. decock using button 113
e. recock
f. fire; cylinder advances when next cocked If the gun is not fired after being cocked a first time, and the hammer is released to decock the gun a first time while the operator pushes and holds control button 113 in accordance with an embodiment of the present invention as described above, after cocking a second time and upon decocking a second time but during this second uncocking the operator does not push and hold button 113, temporary retainer 131 releases retainers 119 and 121 disengaging cylinder pawl 36 so that, when next cocked, pawl 36 will engage the cylinder ratchet and will rotate the cylinder so that the one live round advances and no longer remains in position to be shot. In this embodiment, during decocking while retainer 119 is engaged in temporary retainer 131, temporary retainer 131 releasing retainer 119 can be accomplished by a gunsmith utilizing, for example, modifications made to one or more revolver parts comprised of but not limited to the following shown in FIGS. 1, 2 and 3 of the '190 and '888 patents: the trigger 32, cylinder pawl 10 and or hammer 18. As mentioned above, Power's '888 patent's various parts and/or modified parts, for example, may be used in association with some embodiments of the present invention as would be apparent to those skilled in gun smithing and related machinist arts.

Or, for example, referring to FIG. 1, if button 113 is not held in during decocking while retainer 119 is engaged in temporary retainer 131, temporary retainer 131 releasing retainer 119 can be accomplished in the early travel portion of the hammer connectively operating the pawl (in a single action revolver; in a double action, it would be the early travel portion of the trigger connectively operating the pawl) while traveling toward the safe decocked position (while the trigger traveling to the forward most position) as follows: added means poker 151, cooperating with the hammer, for example, could rest slightly in temporary retainer 131 and then poke further into temporary retainer 131 from the right (non-pin axel 117/boomerang 115 side shown in FIG. 1) so that, if retainer 119 was engaged (but not so far engaged into temporary retainer 131 to take up the whole temporary retainer 131 hole) from the other side of temporary retainer 131 and held in temporary retainer 131 as described, it will be poked loose. Poker means 151 may have a flange type ring 153 as shown with a spring 155 urging it away from temporary retainer 131 while awaiting hammer 5 to increasingly engage slanted surface 157 (which may be slanted some number of degrees so that it is not perpendicular to the shaft of poker means 151, as depicted in FIG. 1) urging it (nudging it) toward retainer 119 in temporary retainer 131 as hammer 5 slowly travels in the early portion of travel toward the decocked position. The hammer 5 surface that contacts slanted surface 157 may be modified with an indent, lug, ridge and or a protrusion of some sort to facilitate nudging slanted surface 157.

In this embodiment, recoil is not necessary to unseat retainer 119 from temporary retainer 131. The right end with the slanted surface 157 of poker means 151 may be accommodated in accommodation 161 built or molded in or cut in or in some other way associated with the frame or body or other part of the revolver. Accommodation 161 is thin enough and poker means 151 is long enough so that slanted surface 157 pokes through accommodation 161 so as to be nudged by the hammer as described above. As described, poker means 151 may be designed so that poker means 151 does not rotate so that slanted surface 157 stays in position to greet the hammer's nudging during decocking. For example, the part of poker means 151 to the right of the flange type ring may be square shaped and accommodation 161 similarly shaped so as to prevent poker means 151 from rotating.

However, if the shooter in this embodiment wants to inhibit cylinder advancement while cocking a third time after the second decocking, he could push and hold button 113 during the second decocking so pin stud retainer 119 on boomerang part 115 engages or reengages temporary retainer 131 during the latter travel portion of the hammer (latter travel portion of the trigger in a double action) traveling toward the decocked position while connectively operating the pawl so that pin stud cylinder pawl retainer 121 on the other end of boomerang 115 moves into or stays in position to hold against added temporary retaining notch 141 in the cylinder pawl 36.

In this and other described embodiments, design considerations for the particular embodiment and the construction of a particular brand and model of revolver could influence the timing relationship between retainer 119 engaging temporary retainer 131 and retainer 121 engaging pawl notch 141; engagement could be substantially simultaneous, or retainer 119 engaging temporary retainer 131 could lead retainer 121 engaging pawl notch 141 or vice versa. As would be apparent to skilled artisans, the modified pawls, associated parts and their modified paths of travel, shown and described in the '888 patent, may be adapted for use in some of the embodiments herein; for example, in relation to disengagement and or the engagement arrangements.

In another embodiment (C), "automatic control operation" may be achieved using recoil: if the gun is cocked but not fired, and the hammer is released slowly to decock the weapon, the act of uncocking alone (no button 113 or a part similar thereto—no thing to push; shaft 112 could be mounted like comparable part shaft 167 in FIG. 3 described below) will cause means added by the gunsmith or during manufacture to engage and hold the cylinder pawl so that when cocked again, the cylinder pawl will not engage the cylinder ratchet and the cylinder will not rotate.

a. cock
b. decock
c. recock
d. decock
e. recock
f. fire; cylinder advances when next cocked Still referring to FIG. 1, for this embodiment, there would be no button 113, but other parts and the operation thereof are similar to the description in association with FIG. 1 above with some differences comprised of the following. In this embodiment, the shooter may have to adjust to the new feature by learning to uncock the hammer more slowly to its forward position and or to release the trigger more slowly to its fully forward position so as not to fire the gun and to allow spring 123 to urge boomerang 115 to the right when pawl notch 141 comes into sufficient alignment position with pin retainer 121 as pawl 36 lowers (described below) so that retainer 121 will engage pawl notch 141 and retain pawl 36. Such urging of boomerang 115 to the right will also allow retainer 119 to engage temporary retainer 131 so that, as above, when the weapon is cocked again cylinder pawl 36 will not engage the cylinder ratchet tooth and therefore will not advance the cylinder so that the one remaining round will stay in place.

As is typical for single action revolvers, in the cocked position, pawl 36, shown in FIG. 2 of the '190 patent for example, is in the raised position of engagement with the tooth of the cylinder ratchet. As the hammer goes from cocked to uncocked, the pawl lowers, for example, according to the single action revolver operation associated with the '190 patent. (Typically, in a double action revolver, the pawl lowers as the trigger is released to its forward most position.) As shown in FIG. 1 of the '190 patent, pawl 36 is in the lower position, so that pawl 36 is unengaged with any teeth of the cylinder ratchet.

In this embodiment the weapon can be cocked and decocked more than once without advancing the cylinder.

Letting the Hammer Down: When the trigger is pulled to fire the revolver in this embodiment (C), the hammer will come down normally fast, fast enough to fire the weapon and fast enough to deny spring 123 enough urging time so that engagement between boomerang 115's pawl retainer 121 with pawl notch 141, and engagement of pin stud 119 into temporary retainer 131, do not occur, so that, when next cocked, the pawl will advance the cylinder in the normal manner. And, if the revolver had been decocked prior to firing so as to allow engagement of retainer 121 with pawl notch 141 and retainer 119 with temporary retainer 131, the recoil of firing will release them from the prior engagement thus allowing cylinder advance in the normal manner when next cocked after firing—this would allow the weapon to fire again upon pulling the trigger if a second live round were aptly chambered in the cylinder.

In a related "automatic control operation" embodiment (D) (no button 113 or a part similar thereto—no thing to push; shaft 112 could be mounted like comparable part shaft 167 in FIG. 3 described below), recoil is not utilized to disengage retainers 119 and 121 when the gun is fired after an decocking that sets (causes engagement) of retainers 121 and 119 with temporary retainer 131 and pawl notch 141. If the gun is cocked but not fired, and the hammer is released slowly to decock the weapon, the act of uncocking will cause added means retainers 119 and 121 to engage and hold the cylinder pawl so that when cocked again, the cylinder pawl will not engage a tooth on the cylinder ratchet and the cylinder will not rotate. In this embodiment, every cocking could disengage retainers 119 and 121 if they are engaged, and every decocking (instead of firing the gun) could engage retainers 119 and 121 (again).

a. cock—if engaged will disengage retainers 119 & 121
b. decock—engages retainers 119 & 121
c. recock—disengages retainers 119 & 121
d. decock—engages retainers 119 & 121
e. recock—disengages retainers 119 & 121
f. fire—will not engage retainers 119 & 121; cylinder advances when next cocked Referring to FIG. 1, added poker means 151 described above could be modified to cooperate with the hammer upon cocking with, for example, poker means similar to poker means 151. In essence, poker means 151 could be turned upside down so slanted surface 157 may be rotated in an opposite orientation to that described above. This slant angle is depicted as slant angle 187 in FIGS. 2 and 4 and described further below.

Attention need not be paid to earlier or latter travel of the hammer as every cocking will disengage retainers 119 and 121 if they are engaged, and, if the shooter decides to decock instead of shooting, slowly uncocking will again engage retainers 119 and 121 as described above, and if the shooter shoots the shot, retainers 119 and 121 will not engage temporary retainer 131 and pawl notch 141 because the speed of the hammer falling to fire the gun will not allow enough time for engagement to occur, as also described above, so the cylinder will advance when next cocked.

Referring now to FIG. 2, which illustrates another embodiment (E) of the present invention, fewer parts are employed. This embodiment does not rely on recoil of the gun when it is fired to disengage pin stud pawl retainer 165 if it is engaged in pawl notch 141 of pawl 36 (pawl notch 141 and pawl 36 are described in detail and depicted in FIG. 1; not shown in FIGS. 2, 3 and 4).

a. cock—if engaged will disengage retainer 165
b. decock—engages retainer 165 using button 169
c. recock—disengages retainer 165
d. decock—engages retainer 165 using button 169
e. recock—disengages retainer 165
f. fire—will not engage retainer 165; cylinder advances when next cocked During decocking, if the shooter pushes and holds button 169 in, retainer 165 will engage pawl notch 141 of pawl 36. When the hammer is next cocked, the hammer passes and nudges slanted end surface 187 (as described above in association with slanted surface 157 of poker means 151 which is rotated in an opposite orientation) of rod 177 and the nudging pushes rod 177 in hole 183 enough to disengage retainer 165 from notch 141 of pawl 36 so that the cylinder will advance normally the next time the gun is cocked.

Only one arm 175 may be utilized in this embodiment. Arm 175 may be fixed on axel rod 177 (arm 175 does not slide on rod 177); arm 175 has pin stud cylinder pawl retainer 165 on one end of arm 175 as shown. Rod 177 slides in and out (to and fro) of accommodating opening 183 on the right and in and out of hollow shaft 167's aperture or hole 174 on the left (opening 183 may be provided on the frame or body or other part of the revolver).

According to FIG. 2, when the revolver is decocked, button 169 may be held in the in position by the shooter so that retainer 165 will engage pawl notch 141 as the pawl lowers while the shooter slowly uncocks the gun; i.e., arm 175 and rod 177 are pushed further into accommodating hole 183 and retainer 165 engages pawl notch 141 (as shown and described for FIG. 1 above) as the pawl lowers during uncocking. After decocking, button 169 may be pushed by spring 181 back to the out position; spring 181 holds button 169 and its shaft 167 in the out position when it is not being pressed by the shooter.

Spring 179 pushes against arm 175 on the left and the rim surrounding and forming hole 183 on the right so as to prevent engagement of retainer 165 with notch 141 on the pawl 36 by urging arm 175 to the left with enough spring power (oomph) to over come spring 181—spring 179 pushes arm 175 toward the left with more force than spring 181 pushes toward the right so that engagement does not occur unless button 169 is pushed by the shooter with greater force yet to over come spring 179's oomph to allow engagement as described above.

The distance arm 175 and rod 177 moves to the right may be limited or stopped by an upper part of arm 175 when it come in contact with pawl 36 (FIG. 1) or by some other means. For example, a stopping or limiting lug or suitable protrusion may be provided on the frame or body or other part of the revolver to aid, limit or stop arm 175 in position when retainer 165 is satisfactorily engaged in pawl notch 141. Once engaged in notch 141 on pawl 36 as described above for FIG. 1, pawl retainer 165 may be held by friction and or aided by using a shape shown exaggerated in the cutout of FIG. 1 and described above for pin 171 and its cone shaped end 173.

Referring now to FIG. 3, another embodiment (F) of the present invention is illustrated. This embodiment uses recoil of the gun when it is fired to disengage pin stud pawl retainer 165 if it is engaged in pawl notch 141 of pawl 36 (pawl notch 141 and pawl 36 are described in detail and depicted in FIG. 1; not shown in FIG. 3).

a. cock
b. decock—engages retainer 165
c. recock—(retainer 165 still engaged)
d. decock—(retainer 165 still engaged)
e. recock—(retainer 165 still engaged)
f. fire—cylinder advances when next cocked Much of the operation of this embodiment is described above. However, in this embodiment, during decocking, spring 181 has enough oomph to overcome spring 179's oomph and causes retainer 165 to engage pawl notch 141 of pawl 36. This engagement may continue through cockings and decockings until the gun is fired at which point, cooperating with spring 179 to over come spring 181, recoil disengages retainer 165 from notch 141. This embodiment may be used with weapons that have ample oomph, e.g., larger caliber weapons, weapons that shoot magnum bullets and or magnum loads, etc.; i.e., this embodiment works with weapons that have sufficient recoil to disengage retainer 165 from notch 141 when fired. FIG. 1's cone shape end 173 as depicted in FIG. 1 may be less or not suitable for this embodiment as it may impede disengagement.

The end of pawl retainer 165 may be similar to a cone shape that tapers down to be somewhat (slightly) narrower at the end to aid disengagement and allow the pawl to advance the cylinder after firing. Various textured or slippery surfaces may also be employed to improve reliability. A correspondingly accommodating shape may be incorporated into notch 141 and edge 175 of pawl 36 (FIG. 1) to more comfortably accommodate the end of pawl retainer 165.

When the hammer is cocked, the hammer does not contact surface 189, which need not be slanted as it does not function as does end 187 of rod 177 described above; i.e., the hammer does not disengage 165 from pawl notch 141 during cocking. And, if engagement occurred from prior decocking, the engagement is allowed to continue if the gun is not fired. Rod 177 slides in and out (to and fro) of accommodating opening 183 on the right of FIG. 3. In this embodiment, mechanical means (not shown) for the shooter to manually disengage retainer 165 could be operated by the shooter in the event of a misfire so that, when cocked after a misfire, the pawl would engage the ratchet tooth and rotate the cylinder. For example, if the frame accommodated opening 183, and rod 177 were long enough to stick out past the frame, the shooter could push rod 177 in order to disengage retainer 165 to allow the pawl to engage the ratchet tooth and rotate the cylinder when the revolver is cocked after a misfire. After a misfire, caution must be taken to not allow the gun to point at anything or in any direction that might be unsafe because a dud could discharge spontaneously after some delay.

Smith & Wesson, for example, advises this:

"If a cartridge fails to fire, wait ten seconds while keeping the muzzle pointed in a safe direction. Keep your finger off the trigger and out of the trigger guard . . . . Remove the defective cartridge and dispose of it in a method specifically approved for live round disposal."

FIG. 4 illustrates another embodiment (G) of the present invention. As described with FIG. 2, this embodiment does not rely on recoil to disengage pin stud pawl retainer 165 if it is engaged in pawl notch 141 of pawl 36 (pawl notch 141 and pawl 36 shown in FIG. 1) when the gun is fired. Arm 175 may be fixed on axel rod 177; arm 175 has pin stud cylinder pawl retainer 165 on one end of arm 175 as shown. Differing from FIG. 2, in FIG. 4 the left end of rod 177 may be rigidly fixed in shaft 167 of button 169 so that button 169, shaft 167 and rod 177 move in unison; button 169, shaft 167 and rod 177 act as one solid piece. Therefore, spring 181 may be not needed in FIG. 4. Rod 177 slides in and out (to and fro) of accommodating opening 183 on the right.

a. cock—if engaged will disengage 165
b. decock—engages retainer 165 using button 169
c. recock—disengages retainer 165
d. decock—engages retainer 165 using button 169 e. recock—disengages retainer 165 f. fire—will not engage retainer 165; cylinder advances when next cocked

During decocking, if the shooter pushes and holds button 169 in, retainer 165 will engage pawl notch 141 of pawl 36. In this embodiment, button 169 stays in after it is held in during decocking. When the hammer is next cocked, the hammer passes and nudges slanted end surface 187 of rod 177 and the nudging pushes rod 177 in hole 183 enough to disengage retainer 165 from notch 141 of pawl 36 and spring 179 will push against arm 175 and push rod 177 thus pushing the button 169 to the out position. The cylinder will advance normally the next time the gun is cocked after the gun is fired.

If the gun is decocked, the shooter must push the button 169 in again to prevent the cylinder rotating when next cocked. If the shooter uses the button to cause engagement during decocking in this embodiment, the button stays in as described, and the shooter can manually pull the button 169 out to disengage retainer 165 from the pawl so that the cylinder will rotate when recocked.

As mentioned above, FIGS. 5, 6 and 7 illustrate a modified pawl with a widened lower portion depicted in the Figures by the expanse or spread of 275 on lower portion 237 of pawl 236 according to an embodiment of the invention. When the retainer is set after the revolver is decocked, the widened lower portion 237 of pawl 236 causes the pawl to be held (further) away from the cylinder's ratchet teeth as the hammer in a single action, or the trigger in a double action, allows the pawl to rise when the revolver is recocked thus preventing the pawl from engaging a ratchet tooth and rotating the cylinder.

FIG. 5 illustrates an embodiment (H) of the present invention. In FIG. 5, the added control element retainer mechanism is shown generally as assembly 203. Pawl 236 has no notch. Knob 215 of assembly 203, according to an embodiment of the invention, is manually positioned [pushed in, through an opening in the frame (the frame shown as 221 with dashed lines and diagonal markings) and held in] by the shooter to retain the pawl while recocking, i.e., during recocking, the shooter holds knob 215 in so that the rounded (cylindrical) side surface at the right end of rod 217 rests flat against surface 241 of pawl 236. While the shooter holds in knob 215 as pawl 236's lower portion 237 rises, lower portion 237 is pushed or urged back away from the ratchet tooth thus preventing engagement of the upper portion of pawl 236 with the ratchet tooth on the cylinder and rotating the cylinder when the revolver is recocked.

If the revolver in this embodiment is decocked more than once, retainer control element (or knob) 215 must be held in each time while the revolver is recocked.

a. cock b. decock c. recock while knob 215 is depressed d. decock e. recock while knob 215 is depressed f. fire; cylinder advances when next cocked In FIG. 5, when the shooter releases knob 215 after the revolved has been recocked and cylinder rotation has been prevented, spring 223 pushes assembly 203 retainer control element 213 coupled (in this embodiment, attached) to connecting element 219 and knob 215 out. Washer like part 227, which is fastened to rod 217 in the position shown, limits the travel of the plunger retainer of control element retainer assembly 203.

FIGS. 6, 6*a*, 6*b*, 6*c* and 7 illustrate embodiments (I) of the present invention. In FIG. 6, the added control element retainer mechanism is shown generally as pawl retainer assembly 211. Knob 215 of pawl retainer assembly 211, according to an embodiment of the invention, is manually positioned to the set position by the shooter (pushed in momentarily and released) through an opening in frame 221. The frame 221 is shown with dashed lines and diagonal markings. To set the retainer, the knob is pushed in after decocking and before recocking, while the pawl is in the down decocked position, so that nail shaped pawl retainer assembly 211 pushes, with edge 235 of nail head 231, pawl 236 which has been modified as shown with a slanted groove 243, 251 to allow pawl 236 to be pushed back enough for inside (underside) surface 233 of nail head 231 to go past the far edge of pawl 236 near pawl edge 249*a* so as to then allow the pawl to come (snap) forward the distance it had been moved back in response to the nail head 231 traversing or sliding across the slanted grove from the groove's curved edge 243 to the far edge 251 of the groove.

When the pawl comes or snaps forward, the revolver's retainer has been set. Depending on ambient noise and conditions, the shooter may hear and/or feel a faint "click" as the pawl snaps forward hitting the shaft of the nail rod 217 closest to the nail head 231. The retainer having been set, the pawl's upper portion 239 will be prevented from engaging the ratchet tooth on the cylinder and rotating the cylinder when the revolver is recocked.

a. cock—if set will reset (un-set)

b. decock—then set with pawl retainer assembly 211 c. recock—no advance, then reset (un-set)

d. decock—then set with pawl retainer assembly 211 e. recock—no advance, then reset (un-set)

f. fire—not set, cylinder advances when next cocked

After the nail shaped retainer 231 shown in FIG. 6 is manually positioned to the set position by the shooter after decocking, when the shooter subsequently recocks the revolver, pawl 236 will rise but it will be prevented—by the shaft of nail rod 217 adjacent to the nail head 231 as the pawl surface 237 rises and pawl edge 249*a* to 249*b* rides against the shaft of the retainer nail rod 217 and surface 233 of the retainer nail head 231—from engaging the cylinder's ratchet tooth and rotating the cylinder. A shooter may be advised to set the retainer immediately after decocking lest he forget to do so before recocking.

Automatic reset of this embodiment:

The nail shaped retainer assembly 211, which will prevent cylinder rotation during the initial portion of recocking, will be automatically reset as the pawl rises to its upper position as the revolver approaches a fully cocked position. Nail head 231 will be pushed flush by surface 247 of added pin stud 245 with pawl 236 surface 237, allowing spring 223 to reset the retainer by pushing the retainer out as nail head surface 231 slides across pawl 236 surface 237, and out of contact with pawl surface 237, back to its reset position (off position).

In FIG. 6, surface 247 of added pin stud 245 pushes the nail head to reset the retainer when the pawl reaches its upper position upon the revolver being recocked. Other shapes, such as ramp shapes shown in FIG. 6*b* or 6*c*, could be utilized instead of pin stud 245 to reset (or un-set) the retainer as the pawl rises to its upper position. Surfaces 247, 247*b* and 247*c*, of added parts 245, 245*b* and 245*c*, serve to push nail retainer head 231 flush with pawl 236 surface 237 allowing spring 223 to reset the retainer by pushing the retainer sliding nail head 231 to its reset position.

FIG. 6*a* depicts a slidable latch to be positioned by the shooter, a different added control element retainer mechanism than pawl retainer assembly 211 in FIG. 6, shown generally as assembly 281. As the shooter slides the latch, its inside slanted latch surface 283 pushes the rounded surface 291 of the retainer so that nail shaped head 231 traverses past slanted groove 243, 251 in the pawl to allow the retainer to be set by pushing the pawl back as described above (the shooter may hear and/or feel a faint "click" as the pawl is urged forward hitting the shaft of the nail under the nail head when the retainer is set). The nail head shape of the retainer will be automatically reset as the pawl rises to its upper fully cocked position by being pushed flush with pawl surface 237 by 245 (or 245*b* or 245*c*) allowing spring 223 to reset the retainer assembly 281.

As described above, the nail shaped retainer will be automatically reset as the pawl rises. Still referring to FIG. 6*a*, when recocking nears completion (i.e., as the hammer nears its fully cocked position (all the way back or cocked) the pawl will rise to its upper position and the nail edge 231 will become flush with pawl surface 237 allowing spring 223 to push the left rounded part 291 of the retainer plunger to reset the retainer automatically by pushing the retainer's rounded surface 291 against inside slanted latch surface 283 causing latch 299 to slide to the reset (un-set) position. It will be understood that surfaces 283 and 291 are appropriately smooth and slippery; for example, surfaces 283 and 291 may be polished, and/or lubricated and/or Teflon coated so they slide readily to the reset position automatically as the revolver reaches a fully recocked position.

FIG. 9 has a different perspective view of pawl 236 shown in FIG. 6*a*. The retainer latch assembly 281 in FIG. 6*a* is not shown in the "set" position. FIG. 9 shows the same retainer latch assembly 281 as FIG. 6*a*, but in FIG. 9 the retainer latch assembly 281 is shown in the "set" position.

After having set the latch 299 in FIG. 6*a*, if the shooter were to slide the latch 299 to the reset position, it would not reset the retainer since the retainer's nail head surface 233 is held generally by the pawl edge 251,249*a*. However, the retainer latch assembly 281 would be reset upon recocking, or, if the shooter wanted the cylinder to advance before pulling the trigger to fire the gun, he could recock, then decock and not set the latch retainer, and recock a second time advancing the cylinder during the second recocking.

In FIG. 6*a*, retainer latch assembly is shown generally as 281. Latch parts 289 and 285, and 293 and 297, position latch 299 so as to allow it to slide in elongated openings (slots) generally depicted by openings 295 and 297 in the frame which is shown as 277 and 279 with dashed lines and diagonal markings. Note that it may be advantageous to make the opening in the frame for retainer rod 217 thicker to, for example, discourage wear over time of the opening and to minimize the possibility of wobble. It will be understood that the surface of the plunger rod 217 which is in the accommodating surface opening or cylindrical hole in the frame are appropriately smooth and slippery, as are the surfaces that slide against each other in elongated openings 295 and 297. For example, the plunger rod 217 slides to and from in the frame's opening to set and reset the pawl retainer, so the surfaces in contact with each other may be polished, and/or lubricated and/or Teflon coated so they can readily move back and forth positioned by the shooter to the set position and automatically positioned to the reset position as the revolver reaches a fully recocked position.

Retainer latch assembly shown generally as 281 in FIG. 6*a* comprises a control element coupled to the retainer which sets and resets the retainer in response to positioning the control element, the control element being accessible to the shooter for setting and resetting the retainer. Retainer latch assembly control element in FIG. 6*a* is minimally susceptible to being inadvertently set.

In FIG. 7, a portion of the control element retainer assembly 211 is shown generally as 207. As the retainer is set by the shooter as described for FIG. 6 or FIG. 6*a*, the nail head retainer 231 traverses past slanted groove 243, 251 in the pawl as described above, but the pawl 236's recess will snap forward to greet the nail head instead of pawl edge 251,249*a* of FIG. 6. The recessed channel 273 is shown and generally defined with solid lines 261 and 263 which are visible at the angle shown of the lower portion 236*a* of pawl 236, and with dashed lines 265 and 267, and 269 and 271, not visible at the angle depicted. The shooter may hear a click as the nail head 231 clears edge 251 of the recessed grove 273 and the pawl 236 is urged or snapped forward. In FIG. 7, the lower portion of the recess 273, shown between dashed curved edges 269 and 271 of the recessed channel indented or cut into surface 237 of the lower portion of the pawl 236, pushes the nail head retainer 231 similar to pin stud 245 in FIG. 6 described above to reset the retainer when the pawl reaches its upper fully recocked position.

In the embodiments depicted in FIGS. 6, 6*a* and 7, the shooter sets the nail head shaped retainer as described after decocking and before recocking. When the retainer is set, the cylinder of the revolver will not advance to the next chamber when recocked. Recocking automatically resets the retainer by the added pin stud 245 in FIG. 6 and by the lower portion of channel 273 which is recessed or indented into the pawl in FIG. 7 as shown and described. After recocking, the cylinder will advance the next time the revolver is cocked (unless the shooter sets the nail head retainer again after another decocking).

While all of the fundamental characteristics and features of the "No-skip upon Recocking Revolver": After Decocking, the Cylinder Does Not Advance Skipping a Round When Recocked have been shown and described, it should be understood that various substitutions, modifications, and variations may be made by those skilled in the art, without departing from the spirit, or scope of the invention. Consequently, all such modifications and variations are included within the scope of the invention as defined by the following claims.

I claim:

1. In a revolver having a hammer, a trigger, a rotating cylinder with chambers therein and ratchet teeth, and a cylinder rotating mechanism including a pawl that engages a ratchet tooth on the cylinder to cause the cylinder to rotate one chamber as the revolver is cocked in response to a shooter pulling the hammer in a single action revolver or in response to either pulling the hammer or pulling the trigger in a double action revolver, an improvement comprising:

a settable and resettable retaining means that is set in association with or following a decocking after a first cocking, the retaining means when set preventing the pawl from engaging a cylinder ratchet tooth and rotating the cylinder when the revolver is recocked, and when reset permitting the cylinder to rotate when the revolver is recocked.

2. The revolver of claim 1, comprising a control element coupled to the retaining means which sets and resets the retainer in response to positioning the control element, the control element being accessible to the shooter for setting and resetting the retainer.

3. The revolver of claim 2, wherein the control element is a depressible button which sets and resets the retaining means in response to the shooter positioning the button.

4. The revolver of claim 2, wherein the control element is a slidable latch which sets the retaining means in response to the shooter positioning the latch.

5. The revolver of claim 1, comprising a control element coupled to the retaining means and to the cylinder ratchet mechanism, the control automatically setting the retainer in response to movement of the cylinder ratchet mechanism in association with decocking.

6. The revolver of claim 1, wherein the retaining means is coupled to the cylinder rotating mechanism and is automatically reset in response to the revolver being recocked.

7. The revolver of claim 1, wherein the retaining means is automatically reset in response to firing recoil of the revolver.

8. In a revolver having a hammer, a trigger, a rotating cylinder with chambers therein and ratchet teeth, and a cylinder rotating mechanism including a pawl that engages a ratchet tooth on the cylinder to cause the cylinder to rotate one chamber as the revolver is cocked in response to a shooter pulling the hammer in a single action revolver or in response to either pulling the hammer or pulling the trigger in a double action revolver, an improvement comprising:

a settable and resettable retainer and an accommodation in the revolver to accommodate the retainer configured to allow the retainer to be set in association with or following a decocking after a first cocking, the retainer when set preventing the pawl from engaging a cylinder ratchet tooth and rotating the cylinder when the revolver is recocked, and when reset permitting the cylinder to rotate when the revolver is recocked.

9. The revolver of claim 8, wherein the retainer is adapted to cooperate with an arm like part configured to allow the retainer to move to the set position.

10. The revolver of claim 8, wherein the retainer comprises a nail like shaped head adapted to cooperate with the pawl.

11. The revolver of claim 8, wherein a control element is configured to set or reset the retainer.

12. The revolver of claim 8, comprising a button like part configured to set or reset the retainer.

13. The revolver of claim 8, comprising a latch like part configured to set the retainer.

14. The revolver of claim 8, comprising a spring configured to urge the retainer.

15. The revolver of claim 8, comprising a washer like part configured to limit the travel of the retainer.

16. In a revolver having a hammer, a trigger, a rotating cylinder with chambers therein and ratchet teeth, and a cylinder rotating mechanism including a ratchet tooth on the cylinder to cause the cylinder to rotate one chamber as the revolver is cocked in response to a shooter pulling the hammer in a single action revolver or in response to either pulling the hammer or pulling the trigger in a double action revolver, an improvement comprising:

a settable and resettable retainer, a pawl adapted to cooperate with the retainer and an accommodation in the revolver to accommodate the retainer configured to allow the retainer to be set in association with or following a decocking after a first cocking, the retainer when set preventing the pawl from engaging a cylinder ratchet tooth and rotating the cylinder when the revolver is recocked, and when reset permitting the cylinder to rotate when the revolver is recocked.

17. The revolver of claim 16, wherein the retainer is adapted to cooperate with an arm like part configured to allow the retainer to move to the set position.

18. The revolver of claim 16, wherein the retainer comprises a nail like shaped head adapted to cooperate with the pawl.

19. The revolver of claim 16, wherein a control element is configured to set or reset the retainer.

20. The revolver of claim 16, comprising a button like part configured to set or reset the retainer.

21. The revolver of claim 16, comprising a latch like part configured to set the retainer.

22. The revolver of claim 16, comprising a spring configured to urge the retainer.

23. The revolver of claim 16, comprising a washer like part configured to limit the travel of the retainer.

* * * * *